US008818257B2

(12) United States Patent
Watanabe et al.

(10) Patent No.: US 8,818,257 B2
(45) Date of Patent: Aug. 26, 2014

(54) CUTTING APPARATUS AND IMAGE FORMING APPARATUS

(75) Inventors: Kiyoshi Watanabe, Matsudo (JP); Kenichi Hayashi, Abiko (JP); Yusuke Obuchi, Abiko (JP); Rikiya Takemasa, Toride (JP); Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 236 days.

(21) Appl. No.: 12/824,660

(22) Filed: Jun. 28, 2010

(65) Prior Publication Data

US 2010/0329768 A1 Dec. 30, 2010

(30) Foreign Application Priority Data

Jun. 30, 2009 (JP) ..... 2009-155678

(51) Int. Cl.
*G03G 15/00* (2006.01)

(52) U.S. Cl.
USPC ..... 399/407; 400/621; 83/836; 83/835

(58) Field of Classification Search
CPC .. B26D 7/1818; B26D 7/088; B26D 2007/18; B26D 2007/1809; B26D 2007/0018
USPC ..... 400/621; 399/407; 83/831–836, 747, 83/869
See application file for complete search history.

(56) References Cited

U.S. PATENT DOCUMENTS

| | | | | | |
|---|---|---|---|---|---|
| 3,277,846 | A | * | 10/1966 | Kesselman | 99/450.2 |
| 4,318,323 | A | * | 3/1982 | Voorhees et al. | 83/168 |
| 4,725,261 | A | * | 2/1988 | Millard et al. | 493/82 |
| 4,821,414 | A | * | 4/1989 | Ducret | 30/90.2 |
| 5,454,287 | A | * | 10/1995 | Fuchigami et al. | 83/881 |
| 5,813,305 | A | * | 9/1998 | Miazga et al. | 83/508 |
| 2005/0074249 | A1 | * | 4/2005 | Nishimura | 399/55 |
| 2006/0169113 | A1 | * | 8/2006 | Hamilton | 83/13 |
| 2007/0267801 | A1 | | 11/2007 | Wakabayashi | |
| 2010/0104342 | A1 | * | 4/2010 | Kohira | 399/407 |
| 2010/0192746 | A1 | * | 8/2010 | Flood et al. | 83/697 |

FOREIGN PATENT DOCUMENTS

| | | | |
|---|---|---|---|
| JP | 02-121228A | U | 10/1990 |
| JP | 2005-114754 | A | 4/2005 |
| JP | 2005-342854 | A | 12/2005 |
| JP | 2006-111349 | A | 4/2006 |
| JP | 2007-307656A | A | 11/2007 |
| JP | 2008-036805A | A | 2/2008 |
| JP | 2008-238394A | A | 10/2008 |

* cited by examiner

*Primary Examiner* — Matthew G Marini
*Assistant Examiner* — Allister Primo
(74) *Attorney, Agent, or Firm* — Canon USA, Inc. IP Division

(57) ABSTRACT

A cutting apparatus configured to cut a sheet or a sheet bundle includes a cutting blade whose blade surface has a plurality of grooves. In the cutting apparatus, a scraping member enters the grooves provided on the blade surface to scrape off cutting scraps remaining after a cutting operation. Accordingly, the cutting apparatus can scrape off cutting scraps from the cutting blade even if the adhesive force of the cutting scraps is great.

19 Claims, 20 Drawing Sheets

CUTTING APPARATUS AND IMAGE FORMING APPARATUS

BACKGROUND OF THE INVENTION

1. Field of the Invention

The present invention relates to a cutting apparatus and an image forming apparatus. In particular, the present invention relates to a cutting apparatus capable of preventing a malfunction of the cutting apparatus occurring due to adhesion or intrusion of cutting scraps to the sheet bundle or into the cutting apparatus, which may adhere to a blade surface of a cutting blade due to electrical charge when a sheet or a sheet bundle including a plurality of sheets is subjected to cutting processing by the cutting apparatus, by surely scraping the cutting scraps off the blade surface of the cutting blade.

2. Description of the Related Art

In a conventional cutting apparatus that conveys a book of a sheet bundle including a plurality of sheets to a predetermined cutting position to cut the book, if the cutting margin is small when the edge of the book is aligned, cutting scraps may adhere to a blade surface of a cutting blade (particularly to a cutting blade leading edge) due to static electricity.

If cutting scraps have adhered to a cutting blade as described above, the adhering cutting scraps may not be collected into a scrap collection portion. In this case, the cutting scraps may come off from the cutting blade at some timing and may drop into a conveyance path of the book. Furthermore, the dropped cutting scraps may intrude into the cutting apparatus. In this case, the cutting scraps that have entered the cutting apparatus may become a cause of malfunction of the cutting apparatus.

In addition, if cutting scraps may drop into a book conveyance path, the dropped cutting scraps may adhere to the book to be conveyed and reaches a book stack unit. In this case, the external appearance of a stacked book may degrade. In addition, in this case, it becomes necessary for an operator of the cutting apparatus to execute an unnecessary operation for removing the cutting scraps adhering to the book by hand.

In order to address the above-described problem, a method discussed in U.S. Patent Application Laid-Open No. 2007/0267801 removes cutting scraps from a cutting blade by pressing a rotational paddle onto the cutting blade. However, in removing cutting scraps by using a paddle as executed in the above-described conventional method, if the adhesive force generated between the cutting blade and the cutting scraps is greater than the scraping force, which is generated by the frictional force generated between the paddle and the cutting scraps, then the cutting scraps may not be effectively removed from the cutting blade by merely pressing and rotating the paddle against and on the cutting blade.

SUMMARY OF THE INVENTION

The present invention is directed to a cutting apparatus capable of surely removing cutting scraps if the adhesive force of cutting scraps to a cutting blade is great.

According to an aspect of the present invention, a cutting apparatus configured to cut a sheet or a sheet bundle includes a movable cutting blade configured to move in the cutting direction and cut the sheet or the sheet bundle, the movable cutting blade having at least one groove which extends in a direction of cutting, and at least one scraper member configured to enter the groove of the movable cutting blade and scrape off cutting scraps.

According to an aspect of the present invention, cutting scraps can be surely removed from a cutting blade because the present invention takes off the cutting scraps from the cutting blade by scraping the cutting scraps adhering to the cutting blade off from the cutting blade by using a scraper member that enters a groove of the cutting blade.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

DESCRIPTION OF THE EMBODIMENTS

Various exemplary embodiments, features, and aspects of the invention will be described in detail below with reference to the drawings.

Figure 1:
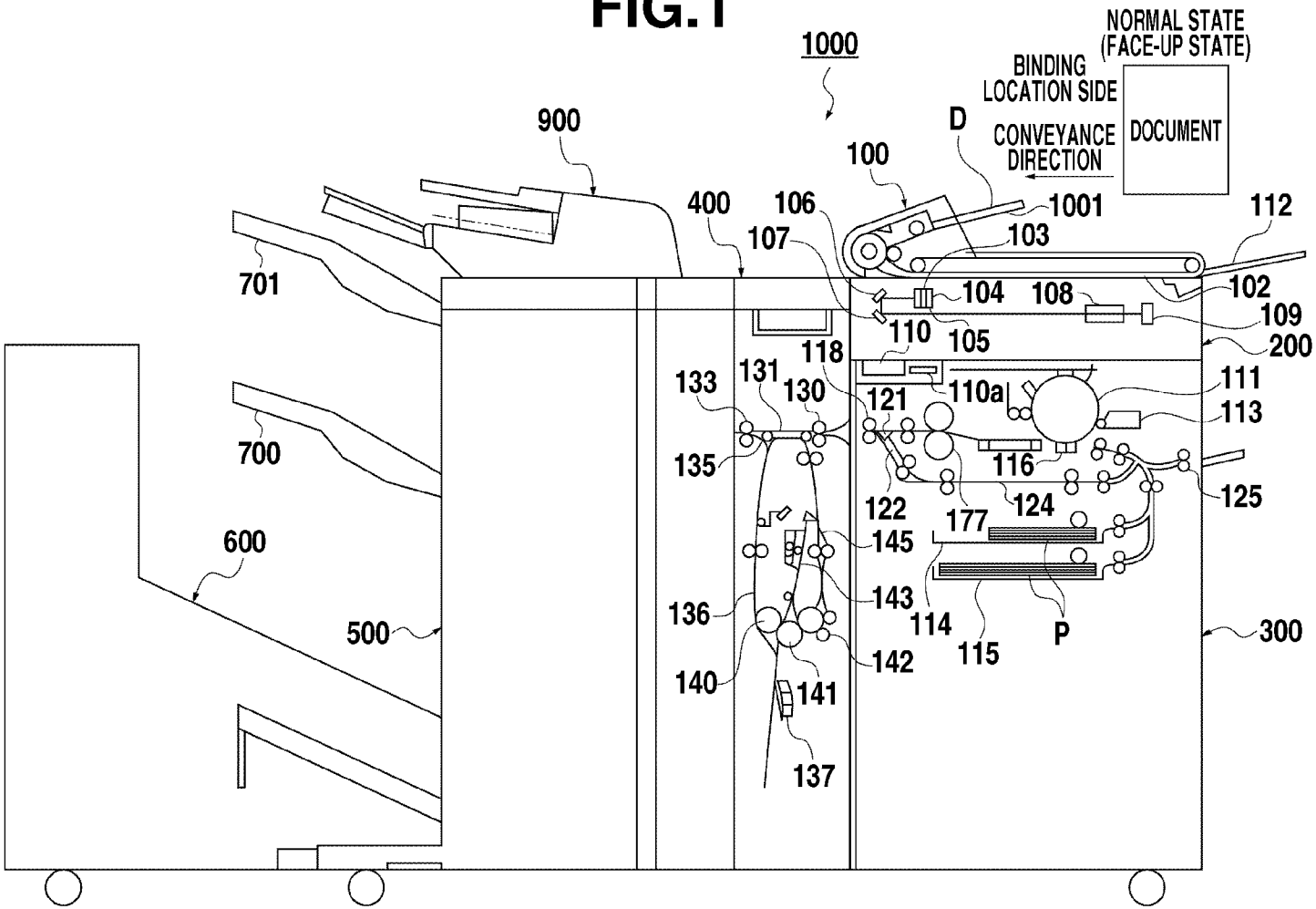
FIG. 1 illustrates an example of an image forming apparatus including a cutting apparatus according to a first exemplary embodiment of the present invention.

Now, a first exemplary embodiment of the present invention will now be described below. FIG. 1 is a cross section illustrating an exemplary inner configuration of a copying machine 1000, which is an image forming apparatus, including a sheet processing apparatus according to the present exemplary embodiment.

Referring to FIG. 1, the copying machine 1000 includes a document feeding unit 100, an image reader unit 200, a printer unit 300, a folding processing apparatus 400, a finisher 500, a saddle stitch binding apparatus 800, and an inserter 900.

The folding processing apparatus 400, the saddle stitch binding apparatus 800, and the inserter 900 can be provided as an optional apparatus, respectively. In the example illustrated in FIG. 1, it is supposed that a document has been set on a tray 1001 of the document feeding unit 100 in a normal orientation seen from a user and in a face-up state (in a state in which the surface of the document on which an image has been formed faces upward). A binding position of the document is positioned in the left edge portion of the document.

The document set on the tray 1001 is conveyed by the document feeding unit 100 leftward (in a direction indicated by an arrow in FIG. 1) page by page from a first page thereof. More specifically, the document sheet is conveyed with the binding position thereof as its leading edge. Furthermore, the document sheet is conveyed on a platen glass 102 via a curved path from left to right in FIG. 1. Then, the document sheet is discharged on a paper discharge tray 112.

At this timing, a scanner unit 104 is stationary at a predetermined position. The document moves from left to right on the scanner unit 104 and is read. In the present exemplary embodiment, the above-described reading method is referred to as a "document feeding-reading method".

When the document sheet is conveyed on the surface of the platen glass 102, the document is irradiated with light by a lamp 103 of the scanner unit 104. Reflection light from the document is guided to an image sensor 109 via mirrors 105, 106, and 107, and a lens 108.

It is also useful if a document is read in the following manner. Namely, a document fed from the document feeding unit 100 is temporarily stopped on the platen glass 102. In this state, the scanner unit 104 is moved from left to right to read the document. In the present exemplary embodiment, the above-described document reading method is referred to as a "document fixed reading method". If a document is read without using the document feeding unit 100, the user lifts the document feeding unit 100 before setting the document on the platen glass 102. In this case, the document is read by the above-described document fixed reading method.

Image data of the document read by the image sensor 109 is subjected to predetermined image processing. Then, the processed image data is transmitted to an exposure control unit 110. The exposure control unit 110 outputs a laser beam according to an image signal. The laser beam irradiates a surface of a photosensitive drum 111 while being scanned by a polygon mirror 110*a*. On the photosensitive drum 111, an electrostatic latent image is formed according to the scanned laser beam.

The electrostatic latent image formed on the photosensitive drum 111 is developed by a development unit 113. The developed image is visualized as a toner image. On the other hand, a recording sheet is fed into a transfer unit 116 from either one of cassettes 114 and 115, a manual paper feed unit 125, and a two-sided conveyance path 124.

Then, the visualized toner image is transferred onto the recording sheet by the transfer unit 116. The photosensitive drum 111, the development unit 113, and the transfer unit 116 constitute an image forming unit of the present invention.

The recording sheet having the image transferred thereon is then subjected to fixing processing by a fixing unit 177. After passing through the fixing unit 177, the recording sheet is first guided by a switching member 121 into a path 122. After the trailing edge of the recording sheet has passed the switching member 121, the recording sheet is switched back to be conveyed by the switching member 121 to a discharge roller 118. The discharge roller 118 discharges the recording sheet from the printer unit 300.

Thus, the recording sheet can be discharged from the printer unit 300 in a state in which the surface thereof having the toner image facing down (in a face-down state). In the present exemplary embodiment, the above-described paper discharge method is referred to as a "reversed paper discharge method".

If recording sheets are discharged in the face-down state and image forming processing is serially executed on the recording sheets from a first page thereof, the normal order of pages can be kept in executing image forming processing in using the document feeding unit 100 and in executing image forming processing on image data from a computer.

In executing image forming processing on both sides of the sheet, the sheet is guided straight from the fixing unit 177 to the discharge roller 118. Furthermore, in this case, the sheet is switched back immediately after the trailing edge thereof has passed the switching member 121. The switched sheet is further guided by the switching member 121 into a two-sided conveyance path.

Now, an exemplary configuration of the folding processing apparatus 400 and the finisher 500 will be described in detail below with reference to FIGS. 1 and 2.

The folding processing apparatus 400 includes a conveyance path 131. The conveyance path 131 guides the sheet discharged from the printer unit 300 into the finisher 500. On the conveyance path 131, a conveyance roller pair 130 and a discharge roller pair 133 are provided.

In addition, a switching member 135 is provided in the vicinity of the discharge roller pair 133. The switching member 135 guides the sheet conveyed by the conveyance roller pair 130 to a folding path 136 or the finisher 500. More specifically, in executing processing for folding the sheet, the switching member 135 is switched towards the folding path 136 to guide the sheet to the folding path 136. The sheet guided into the folding path 136 is conveyed to a folding roller 140. The folding roller 140 z-folds the sheet.

On the other hand, if the sheet is not to be folded, the switching member 135 is switched towards the finisher 500. The sheet that has been discharged from the printer unit 300 is directly into the finisher 500 via the conveyance path 131.

In folding the sheet, the conveyance of the sheet is controlled so that the leading edge of the sheet contacts a stopper 137 after the sheet is conveyed via the folding path 136. Thus, the sheet is looped and folding rollers 140 and 141 folds the looped sheet. The sheet is further folded by folding rollers 141 and 142 at a part of the loop of the sheet formed by causing the folded portion of the sheet to contact an upper stopper 143. Thus, the sheet is z-folded.

The z-folded sheet is conveyed into the conveyance path 131 via the conveyance path 145. After that, the sheet is discharged onto the finisher 500, which is provided downstream of the discharge roller pair 133. The folding processing by the folding processing apparatus 400 is selectively executed.

The finisher 500 executes processing for aligning a plurality of sheets, which has been conveyed from the printer unit 300 via the folding processing apparatus 400, and bundling the plurality of sheets into one sheet bundle. In addition, the finisher 500 executes stapling processing (binding processing) for stapling the sheet bundle. Furthermore, the finisher 500 executes sorting processing and non-sorting processing.

Figure 2:
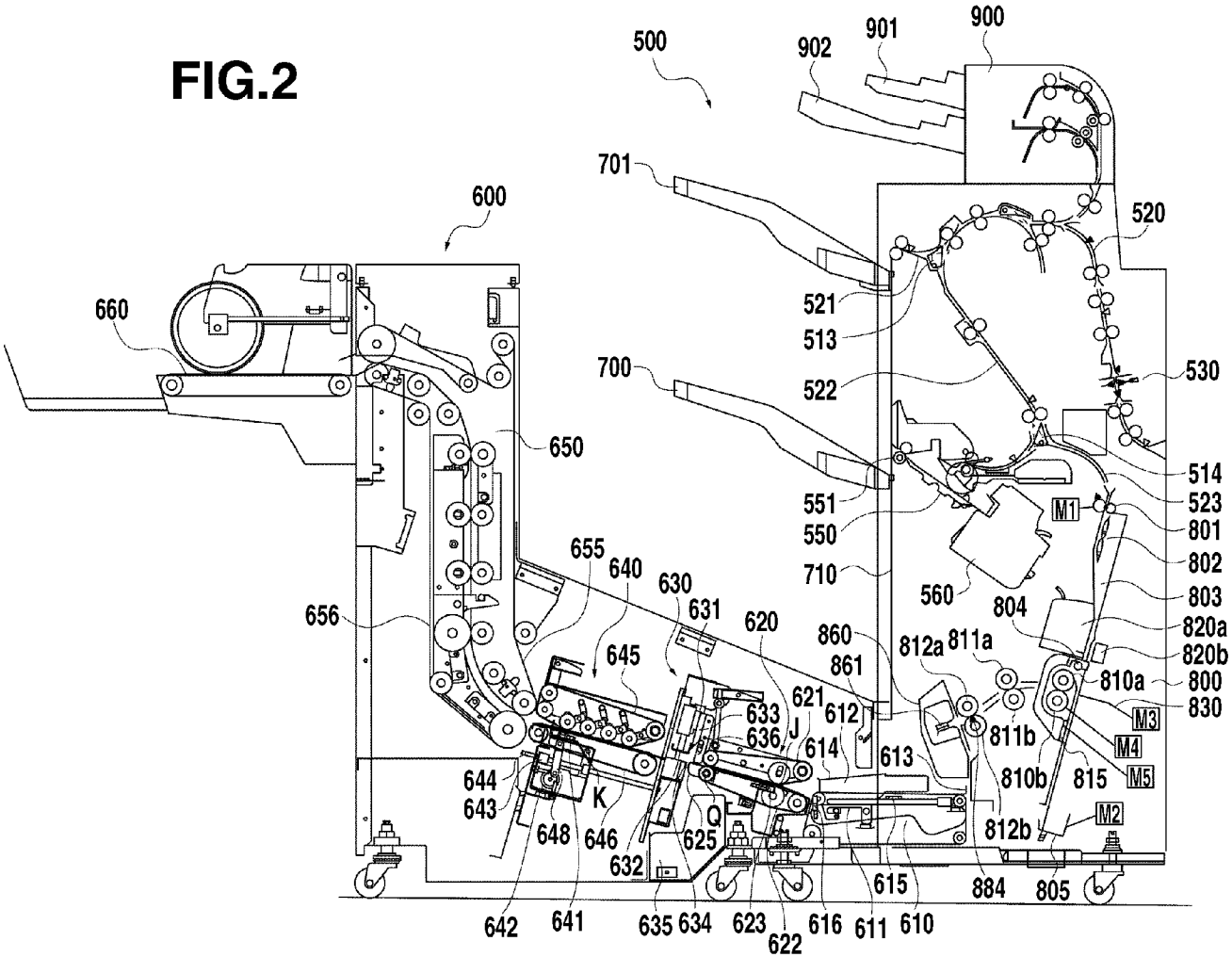
FIG. 2 illustrates an exemplary configuration of the cutting apparatus.

FIG. 2 illustrates an example of main components of the sheet processing apparatus according to an exemplary embodiment of the present invention.

Referring to FIG. 2, the finisher 500 includes a conveyance path 520. The conveyance path 520 is a path for conveying the sheet that has been conveyed via the folding processing apparatus 400 into the finisher 500. The conveyance path 520 includes a plurality of conveyance roller pairs.

A punching unit 530 is provided at a predetermined middle position of the conveyance path 520. The punching unit 530 operates where necessary to execute punching processing on the conveyed sheet in a portion of the sheet close to the trailing edge thereof.

A switching member 513 is provided at the trailing end of the conveyance path 520. The switching member 513 switches the conveyance path for conveying the sheet between an upper paper discharge path 521 and a lower paper discharge path 522, which is connected to the conveyance path 520 on the downstream side of the conveyance path 520 in the sheet conveyance direction. The upper paper discharge path 521 is a path for discharging the sheet to an upper stack tray. On the other hand, the lower paper discharge path 522 is a path for discharging the sheet onto a processing tray 550.

Figure 6:
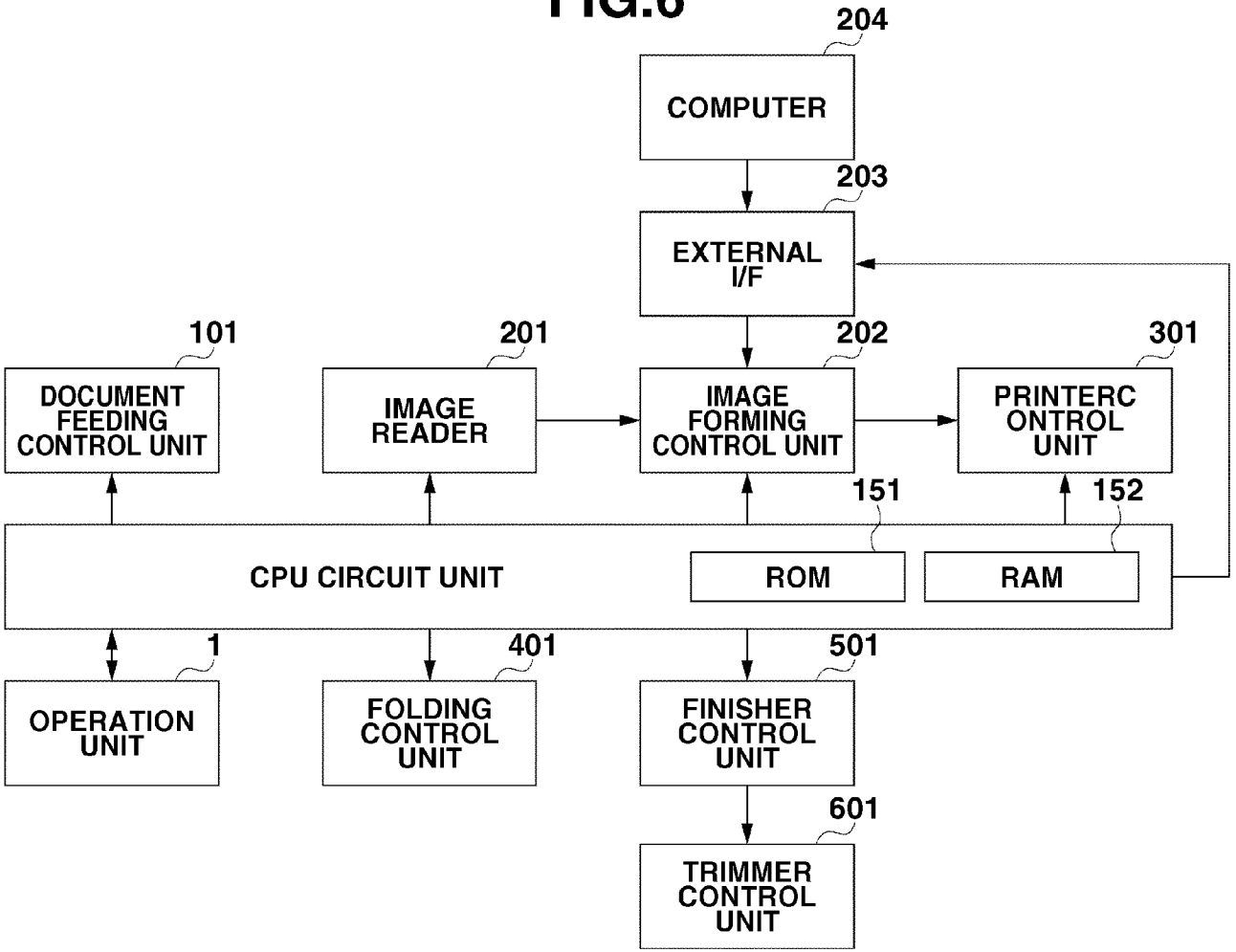
FIG. 6 is a control block diagram illustrating an example of the image forming apparatus.

Sheets discharged onto the processing the tray 550 are serially aligned and stored as a sheet bundle. The sheet bundle is subjected to sorting processing and stapling processing according to a setting set via an operation unit 1 (FIG. 6). The processed sheet bundle is then discharged by a sheet bundle discharge roller pair 551 onto stack trays 700 and 701.

The above-described stapling processing is executed by the stapler 560. The stapler 560 can move in a direction of width of the sheet, which is perpendicular to the sheet conveyance direction. The stapler 560 can execute stapling processing on the sheet at an arbitrary location on the sheet.

The stack trays 700 and 701 can elevate in the vertical direction. The upper stack tray 701 can stack sheets conveyed from the upper paper discharge path 521 and the processing tray 550. The lower stack tray 700 can stack sheets conveyed from the processing tray 550.

The stack trays 700 and 701 can stack a large quantity of sheets. The trailing edge of the stacked sheets is regulated by a trailing edge guide 710, which extends in the vertical direction, to be aligned.

In the example illustrated in FIG. 2, the inserter 900 feeds the sheets set by the user on insertion trays 901 and 902 onto either one of the stack tray 700, the stack tray 701, and a paper discharge tray 850 without causing the sheets to pass through the printer unit 300. A bundle of sheets stacked on the insertion trays 901 and 902 is separated sheet by sheet. The sheets separated from the insertion trays 901 and 902 are converged into the conveyance path 520 at a predetermined timing.

Now, an exemplary configuration of the saddle stitch binding apparatus 800 will be described in detail below. As illustrated in FIG. 2, a switching member 514 is provided in the lower paper discharge path 522 at a certain location thereof. The sheet whose conveyance direction has been switched rightward in FIG. 2 passes through a paper discharge path 523 to be conveyed into the saddle stitch binding apparatus 800.

The sheet is further conveyed to an entrance roller pair 801. The entrance port for the sheet is selected by a switching member 802. The switching member 802 is operated by a solenoid according to the size thereof. Then, the sheet is conveyed into a storing guide 803 of the saddle stitch binding apparatus 800.

The conveyed sheet is further conveyed by a sliding roller 804 to a positioning member 805. The leading edge of the positioning member 805 is movable. The entrance roller pair 801 and the sliding roller 804 are driven by a motor Ml.

A stapler 820, which includes a driver 820*a* and an anvil 820*b*, is provided on the storing guide 803 at a certain location thereof. The driver 820*a* and the anvil 820*b* are provided across the storing guide 803 so as to face each other. The driver 820*a* ejects a staple out. The anvil 820*b* folds the ejected staple.

In conveying the sheet, the positioning member 805 stops at a position at which the center of the sheet in the sheet conveyance direction comes to a binding (stapling) position of the stapler 820. The positioning member 805 is driven by a motor M2 and can freely move. The position of stopping the positioning member 805 is changed according to the sheet size.

A folding roller pair 810 includes folding rollers 810*a* and 810*b*. The folding roller pair 810 is provided downstream of the stapler 820 in the sheet conveyance direction. A protruding member 830 is provided at a position on the storing guide 803 opposite to a nip between the folding rollers 810*a* and 810*b*.

A home position of the protruding member 830 is set at a position at which the protruding member 830 is retracted from the storing guide 803. The protruding member 830 protrudes by the driving by the motor M3 towards the stored sheet bundle. Thus, the protruding member 830 operates to fold the sheet bundle while pressing the sheet bundle into the nip between the folding roller pair 810*a* and 810*b*. After folding the sheet bundle, the protruding member 830 returns to the home position. A spring (not illustrated) provides pressure high enough to fold the sheet bundle on the folding rollers 810*a* and 810*b*.

The folded sheet bundle is discharged on the paper discharge tray 850 via a first conveyance roller pair 811*a* and 811*b* and a second conveyance roller pair 812*a* and 812*b*. The first conveyance roller pair 811*a* and 811*b* and the second conveyance roller pair 812*a* and 812*b* are subjected to sufficient pressure. The first conveyance roller pair 811*a* and 811*b* and the second conveyance roller pair 812*a* and 812*b* are used for conveying and stopping the folded sheet bundle by further pressing the sheet bundle.

The folding roller pair 810, the first conveyance roller pair 811, and the second conveyance roller pair 812 are driven by the same motor M4 (not illustrated) to be rotated at the same rotational speed.

In folding the sheet bundle bound by the stapler 820, the positioning member 805 is descended from a position at which the stapling processing is executed so that the position for stapling the sheet bundle comes to the position of the nip of the folding roller pair 810 after the stapling processing ends. In the above-described manner, the sheet bundle can be folded at the position at which the sheet bundle is stapled.

An alignment board pair 815 has a surface that extends around outer peripheries of the folding rollers 810*a* and 810*b* and protrudes towards the storing guide 803 so as to align the sheet stored by the storing guide 803. The alignment board pair 815 is driven by a motor M5. The alignment board pair 815 moves in a direction of nipping the sheet to align the position of the sheet in the direction of the width of the sheet.

In addition, a pressure unit 860 is provided downstream of the second conveyance roller pair 812. The paper discharge tray 850 is spatially overlapped with the paper discharge tray 850. The pressure unit 860 includes a pressure roller pair 861. The pressure roller pair 861 nips the fold of the sheet bundle. Furthermore, the pressure roller pair 861 moves along the fold of the sheet bundle in the sheet width direction to tighten the fold of the sheet bundle. In the above-described manner, the sheet bundle including a plurality of sheets is folded into a book.

Now, a trimmer unit 600, which cuts the book at the edge thereof, will be described in detail below.

In the example illustrated in FIG. 2, the trimmer unit 600 includes, in order from the upstream in the sheet conveyance direction, a first conveyance unit 610, a second conveyance unit 620, a trimming unit 630, a third conveyance unit 640, a fourth conveyance unit 650, and a paper discharge unit 660.

The first conveyance unit 610 includes a lower conveyance belt 611 and a side guide 612. The lower conveyance belt 611 supports the lower surface of the folded sheet bundle conveyed from the saddle stitch binding apparatus 800. The side guides 612, which are driven by a driving motor M12 (FIG. 7), are provided on both sides of the lower conveyance belt 611. The side guide 612 moves in the sheet width direction to correct a skewed sheet bundle.

A pressure guide 614 is provided to the side guide 612 to prevent the sheet bundle from becoming unbundled. Accordingly, the sheet bundle can be smoothly conveyed into the second conveyance unit 620.

A first entrance port sensor 615 is provided at a location upstream of the pressure guide 614 in the sheet conveyance direction. The first entrance port sensor 615 is a sensor for detecting the presence or absence of a sheet bundle. A first exit port sensor 616 is provided at a location downstream of the pressure guide 614 in the sheet conveyance direction. The first exit port sensor 616 is also a sensor for detecting the presence or absence of a sheet bundle.

Conveyance claws 613 are provided on both sides of the lower conveyance belt 611. The conveyance claw 613 can move in the sheet conveyance direction and moves at the same speed as the speed of moving of the lower conveyance belt 611 to convey the sheet bundle to the second conveyance unit 620.

If sliding of the sheet bundle on the lower conveyance belt 611 has occurred, the conveyance claw 613 contacts the end of the sheet bundle on the upstream side in the sheet conveyance direction to securely convey the sheet bundle by holding and pressing the sheet bundle at the end of the sheet bundle on the upstream side in the sheet conveyance direction.

Now, a configuration of the trimming unit 630 will be described in detail below with reference to FIGS. 3 and 4. In the examples illustrated in FIGS. 3 and 4, parts provided around the third conveyance unit 640 only are illustrated and other parts, such as the upper conveyance belts, are omitted.

Figure 3:
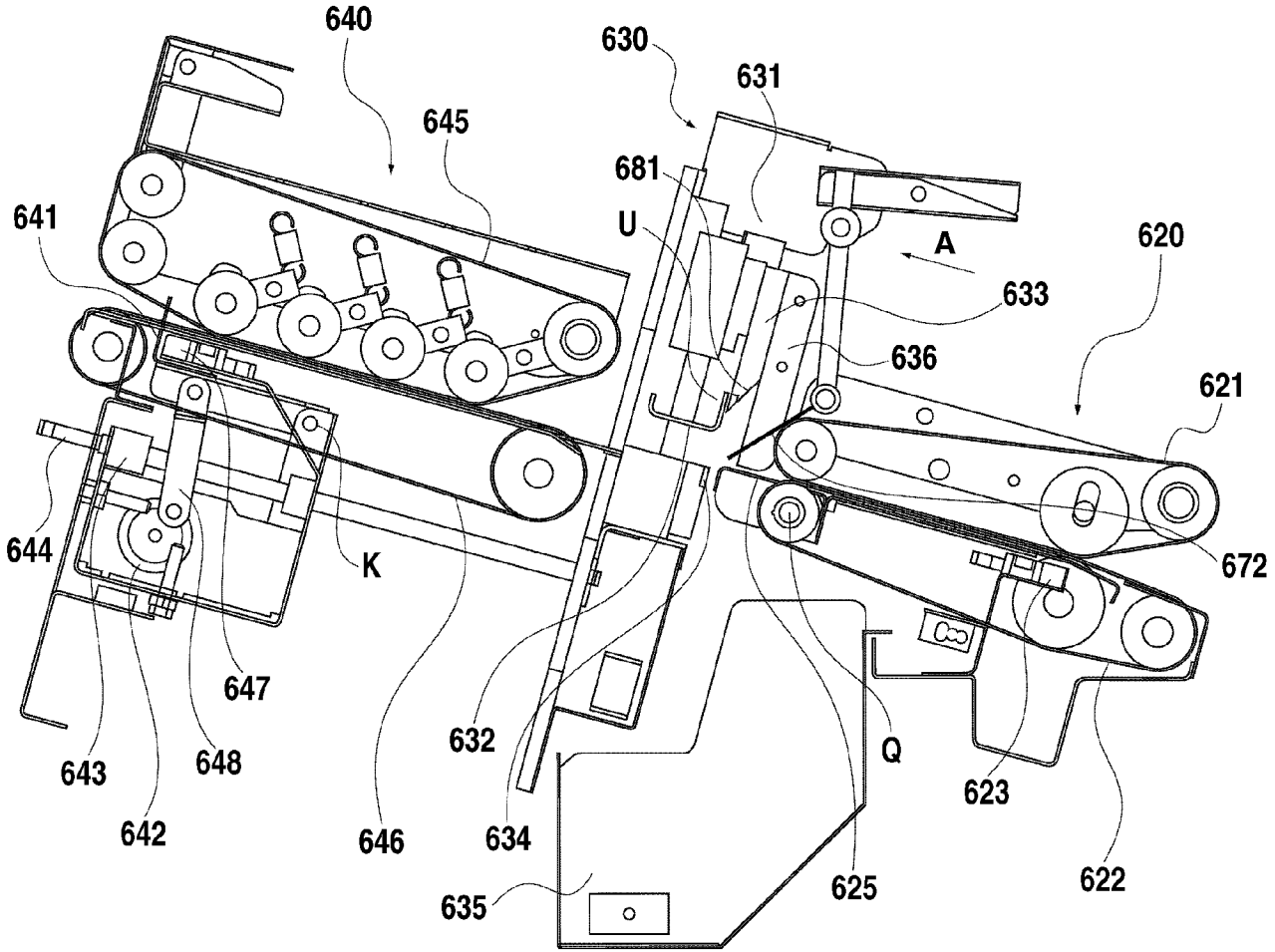
FIG. 3 illustrates an example of a trimming unit of the cutting apparatus.

Referring to FIG. 3, the second conveyance unit 620 includes one pair of conveyance belts 621 and 622. Similarly, the third conveyance unit 640 includes one pair of conveyance belts 645 and 646. The upper and lower conveyance belts of each of the second conveyance unit 620 and the third conveyance unit 640 are driven by the same motor and has the same conveyance speed.

A second entrance sensor 623 is provided downstream of a nip portion (a nip J) of the second conveyance unit 620 in the sheet conveyance direction. The second conveyance unit 620 detects that a book is conveyed into the second conveyance unit 620. The third conveyance unit 640 includes a stopper 641, which can protrude and retract into and from the sheet bundle conveyance path. The stopper 641 can move in the sheet conveyance direction.

The stopper 641 is driven to be rotated by a motor around a portion K via cams 642 and 648. The stopper 641 can protrude and retract into and from the sheet bundle conveyance path as described above. The stopper 641 is provided to a sliding block 643 and is driven by a motor (not illustrated) along a sliding guide 644. In addition, the stopper 641 moves according to the length of the sheet bundle in the sheet conveyance direction and the stopping position of the sheet bundle.

The fourth conveyance unit 650 includes one pair of conveyance belts including an upper conveyance belt 655 and a lower conveyance belt 656. The upper and lower conveyance belts 655 and 656 are driven by the same motor and are rotated at the same conveyance speed. The fourth conveyance unit 650 conveys the sheet bundle upward.

Figure 4:
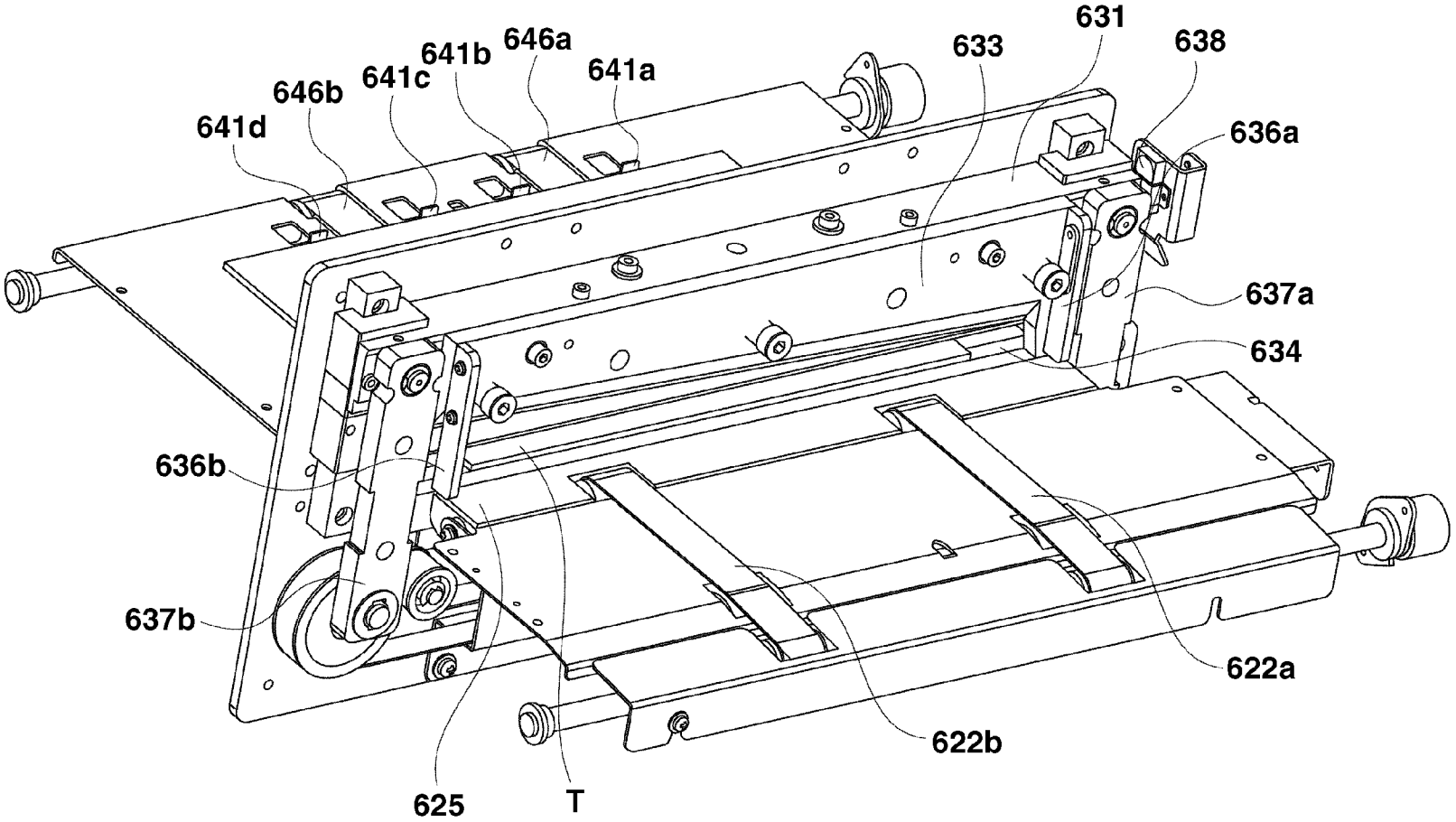
FIG. 4 is a perspective diagram illustrating an example of the trimming unit of the cutting apparatus.

Referring to FIG. 4, a cutter unit 631, which can move in a direction perpendicular to the sheet bundle conveyance direction, is provided to the trimming unit 630. The cutter unit 631 is driven by a motor (not illustrated) and is moved via a link 637 in a direction perpendicular to the sheet bundle conveyance plane. The cutter unit 631 includes a pressure member 632 and an upper blade 633, which is a cutting blade. When the cutter unit 631 descends, the pressure member 632 contacts the sheet bundle first.

The pressure member 632 is biased by a spring (not illustrated) against the sheet bundle conveyance plane. When the cutter unit 631 further descends, the upper blade 633 contacts the sheet bundle while the pressure member 632 is causing the spring to contract in a state in which the sheet bundle is nipped by the pressure member 632.

The sheet bundle can be cut by the upper blade 633 and a lower blade 634, which is a fixed blade provided at a location within the pressure member 632 opposite to the descendible upper blade 633 across the sheet bundle. In addition, a scraper blade 672 served as a scraper member is provided in the proximity of the upper blade 633.

Figure 5:
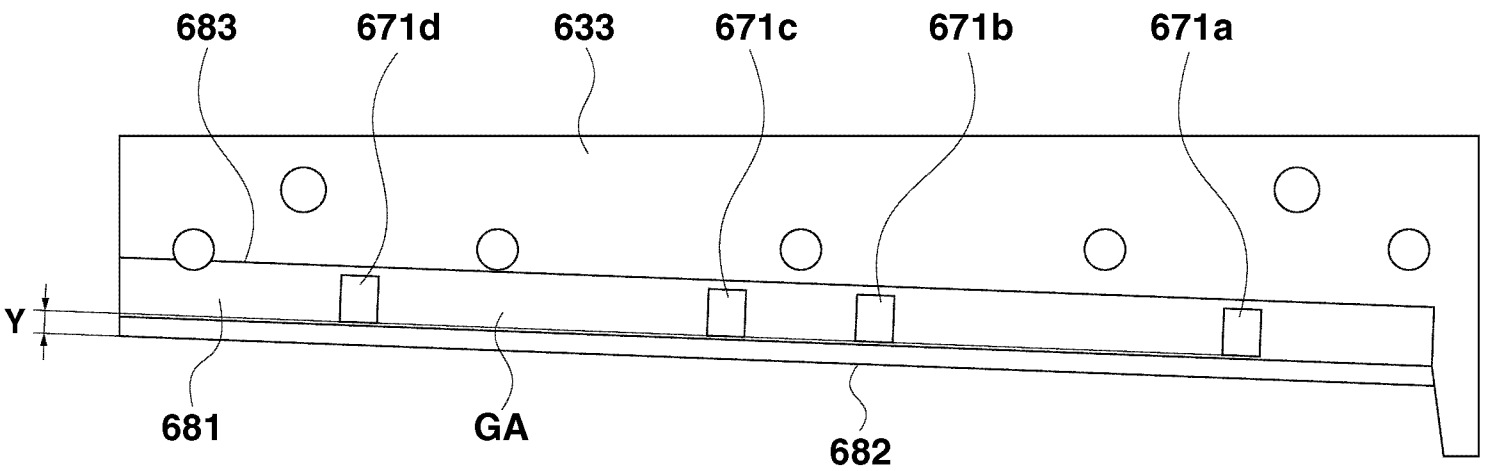
FIG. 5 illustrates an example of a cutting blade of the cutting apparatus.

As illustrated in FIG. 5, a plurality of grooves 671*a* through *d* is provided to a tapered portion 681 of the upper blade 633. More specifically, the tapered portion 681 is a portion of the upper blade 633 between a blade cutting edge 682 and a step portion 683. Each of the plurality of grooves 671*a* through *d* extends in the direction of cutting the sheet bundle, in which direction the upper blade 633 can move. Accordingly, the leading edge of the scraper blade 672 (FIG. 3) can enter the groove 671 during a cutting operation. The present invention is not limited to the exemplary configuration described above. More specifically, it is also useful, at least one groove and at least one scraper member may be provided.

When the upper blade 633 ascends from the descended position, the scraper blade 672 slides on and frictionally scrapes the inside of the grooves 671*a* through *d* of the tapered portion 681 starting from the step portion 683 towards the blade cutting edge 682. The scraper blade 672 is a conductive elastic member such as a conductive rubber, or a conductive resin sheet. Accordingly, the scraper blade 672 can easily come in close contact with the tapered portion 681. In addition, charged cutting scraps cannot easily adhere to the scraper blade 672. Because the scraper member (the scraper blade 672) according to the present exemplary embodiment is an elastic member, the scraper blade 672 can securely contact the cutting blade.

In addition, a scrap receptacle (dust bin) 635 is provided in a lower portion of the cutter unit 631. The scrap receptacle 635 stores the cutting scraps generated by the cutting by the cutter unit 631.

Furthermore, a shutter 625 is provided to the cutter unit 631. The shutter 625 opens or closes a passage of cutting scraps to the scrap receptacle 635 according as the cutter unit 631 descends. When the cutter unit 631 executes a cutting operation, a cam 636, which is provided outside the sheet bundle conveyance region, presses the shutter 625. Pressed by the cam 636, the shutter 625 pivots round a shaft Q on the downstream side of the second conveyance unit 620 in the sheet conveyance direction.

When not being pressed by the cam 636, the shutter 625 is biased by a twisted coil spring (not illustrated). Accordingly, the shutter 625 can function as a conveyance guide between 622 and the lower blade 634. Thus, the shutter 625 closes the passage of cutting scraps to the scrap receptacle 635.

The paper discharge unit 660 is provided at the most downstream location in the sheet conveyance direction. The paper discharge unit 660 stacks the sheet bundle conveyed by the fourth conveyance unit 650.

FIG. 6 is a block diagram illustrating an exemplary inner configuration of the copying machine 1000.

Referring to FIG. 6, the central processing unit (CPU) circuit unit 150 includes a CPU (not illustrated). The CPU circuit unit 150 controls a document feeding control unit 101, an image reader control unit 201, an image signal control unit 202, a printer control unit 301, a folding processing control unit 401, a finisher control unit 501, and an external I/F 203 according to a control program stored on a read-only memory (ROM) 151 and a setting set via the operation unit 1.

The document feeding control unit 101 controls the document feeding unit 100. The image reader control unit 201 controls the image reader unit 200. The printer control unit 301 controls the printer unit 300. In addition, the folding processing control unit 401 controls the folding processing apparatus 400. The finisher control unit 501 controls the finisher 500, the saddle stitch binding apparatus 800, and the inserter 900. A trimmer control unit 601 controls the trimmer unit 600 according to a command from the finisher control unit 501.

The operation unit 1 includes a plurality of keys for setting various functions for forming an image. In addition, the operation unit 1 includes a display unit that displays a content of the setting. The operation unit 1 outputs a key signal corresponding to a user operation of each key to the CPU circuit unit 150. Furthermore, the operation unit 1 displays corresponding information according to a signal from the CPU circuit unit 150.

A random access memory (RAM) 152 functions as a temporary storage area of the CPU (not illustrated) for temporarily storing control data and also as a work area for executing calculation necessary during the control.

The external I/F 203 is an interface between the copying machine 1000 and an external computer 204. The external I/F 203 rasterizes print data from the external computer 204 into a bitmap image and outputs the bitmap image to the image signal control unit 202 as image data.

An image of a document read by an image sensor (not illustrated) is output from the image reader control unit 201 to the image signal control unit 202. The printer control unit 301 outputs the image data from the image signal control unit 202 to an exposure control unit (not illustrated).

Figure 7:
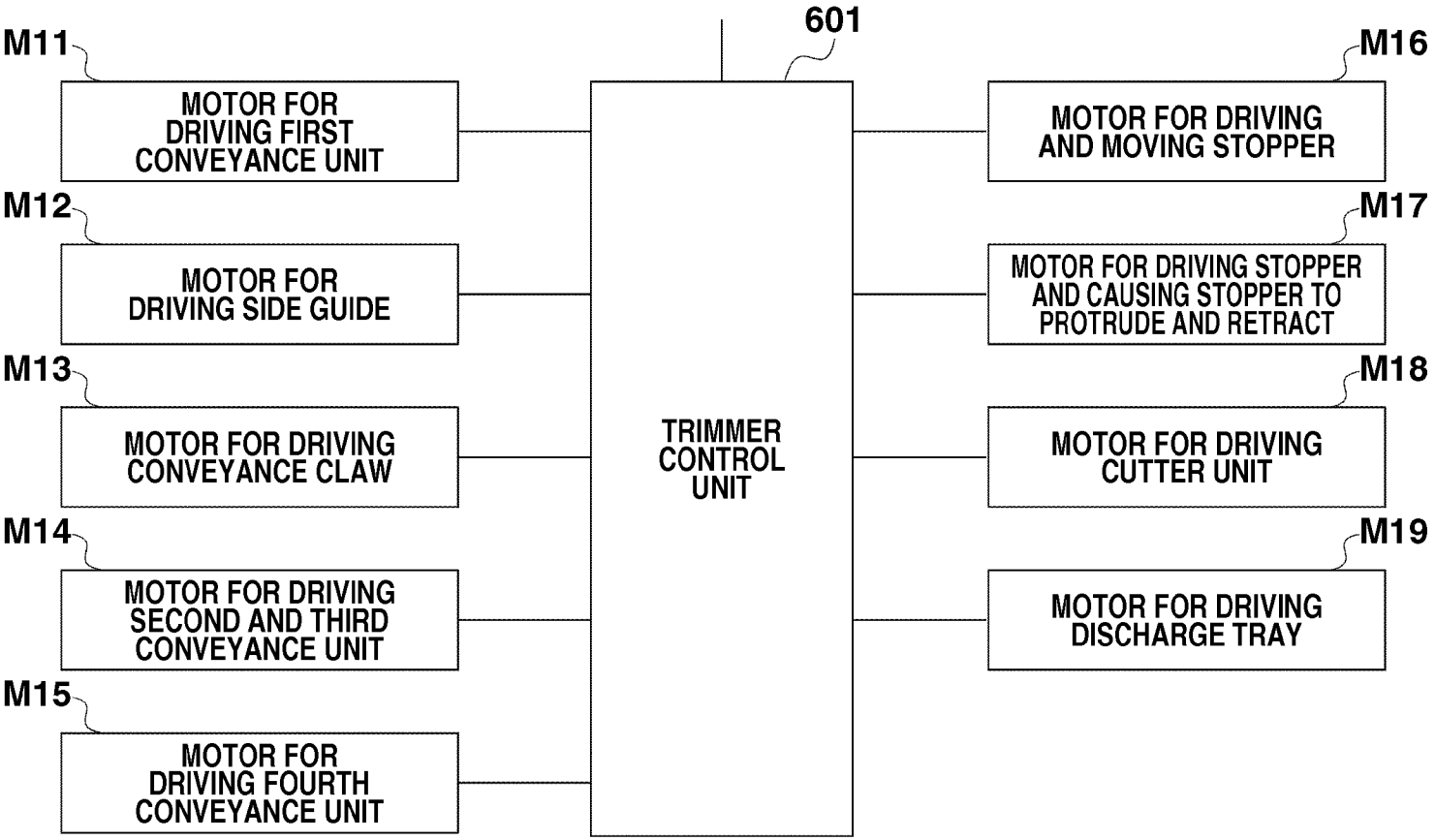
FIG. 7 is a control block diagram illustrating an example of the cutting apparatus.

Now, a sheet cutting operation executed by the trimmer unit 600 according to the present exemplary embodiment will be described in detail below focusing on how each unit operates as a sheet bundle is conveyed. FIG. 7 is a block diagram illustrating an exemplary configuration of the trimmer control unit 601. The trimmer control unit 601 controls each driving motor.

Now, an exemplary cutting operation executed by the trimmer unit 600 will be described in detail below with reference to a flow chart of FIG. 8. After the conveyance of the sheet bundle, whose fold has been tightened by the pressure unit 860, is resumed, the sheet bundle is conveyed into the first conveyance unit 610 of the trimmer unit 600.

Then, the lower conveyance belt 611 of the first conveyance unit 610 is driven and rotated by a driving motor M11 (FIG. 7) to convey the sheet bundle. After the sheet bundle is detected by the first exit port sensor 616, the conveyance of the sheet bundle is temporarily stopped. After that, the side guides 612, which are provided on both sides of the sheet bundle conveyance path, are driven by a driving motor M11 to execute an alignment operation.

Subsequently, the conveyance claw 613, which is provided upstream of the first conveyance unit 610, and the lower conveyance belt 611 resume the conveyance of the sheet bundle. The conveyance claw 613 is driven by a driving motor M13 (FIG. 7).

If the second entrance sensor 623, which is provided at the nip J of the second conveyance unit 620, detects the presence of the sheet bundle, then the conveyance claw 613 retracts towards the upstream side of the sheet conveyance direction. Then, the processing illustrated in FIG. 8 starts.

Figure 8:
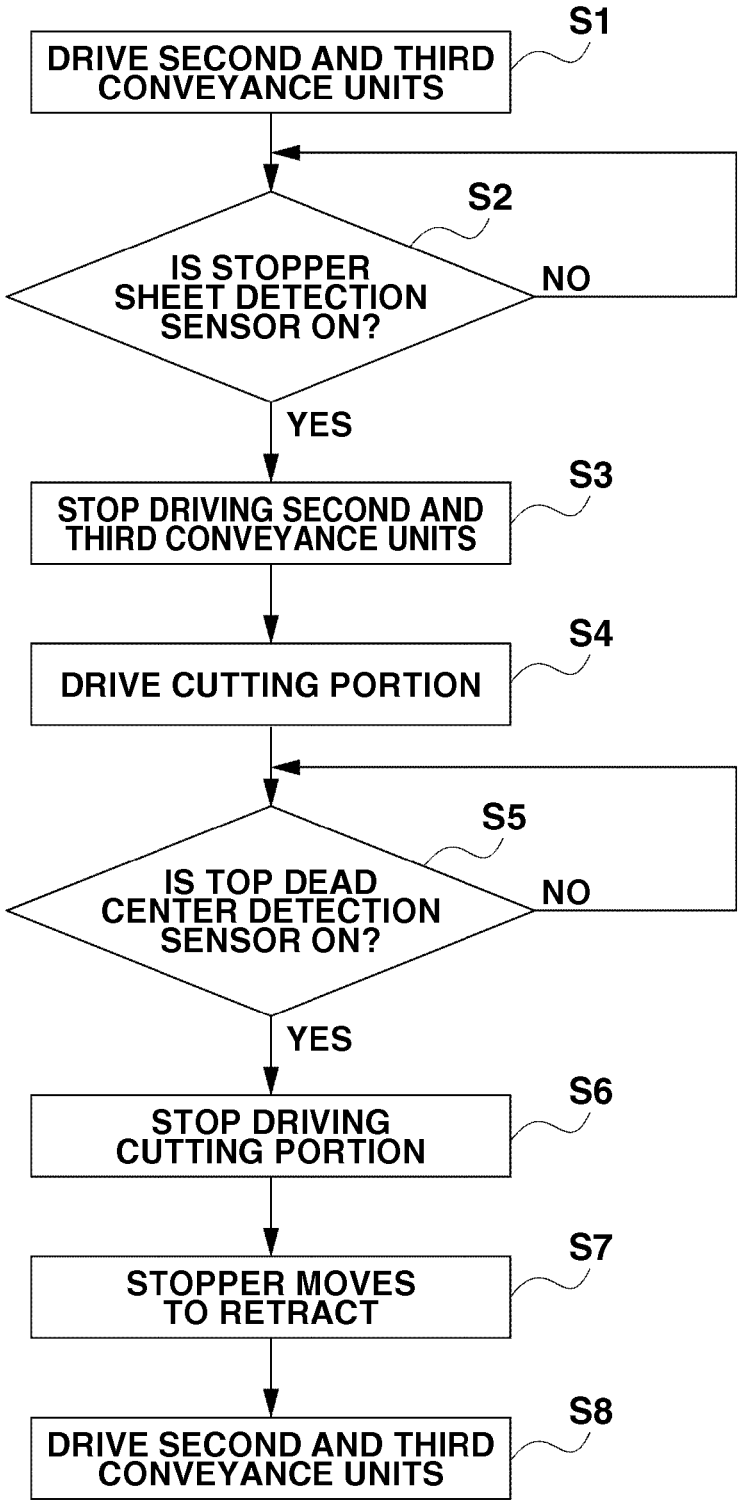
FIG. 8 is a flow chart illustrating an exemplary cutting operation executed by the cutting apparatus.

Referring to FIG. 8, in step S1, the edge of the sheet bundle oriented in the downstream side of the sheet conveyance direction thereof passes the second conveyance unit 620 and the trimming unit 630, and then the sheet bundle is conveyed into the third conveyance unit 640. The conveyance belts of the second conveyance unit 620 and the third conveyance unit 640 are driven by the same driving motor M14 (FIG. 7).

In the third conveyance unit 640, the stopper 641 is driven by a driving motor M16 (FIG. 7) to be moved and stopped at a predetermined position according to the size of the conveyed sheet bundle and the cutting amount. The stopper 641 is driven by a driving motor M17 to protrude into the sheet bundle conveyance path.

Figure 9:
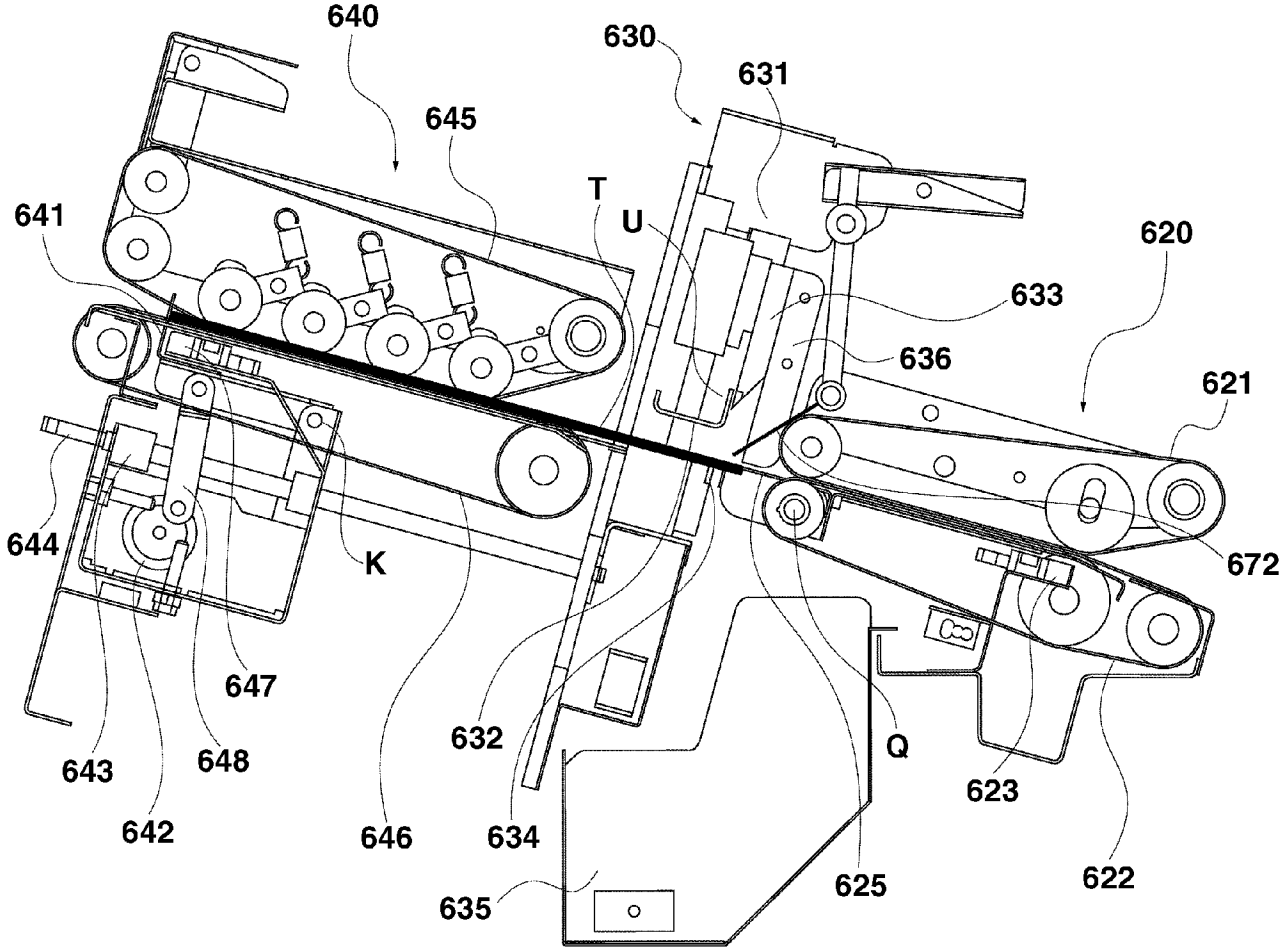
FIG. 9 illustrates an exemplary cutting operation executed by the cutting apparatus.

In step S2, the edge of the conveyed sheet bundle oriented to the downstream side of the sheet bundle conveyance direction contacts the stopper 641 and is stopped there to be detected by a sheet detection sensor 647. FIG. 9 illustrates an example of a state in which the edge of the conveyed sheet bundle oriented to the downstream side of the sheet bundle conveyance direction contacts the stopper 641 to be stopped there.

Figure 10:
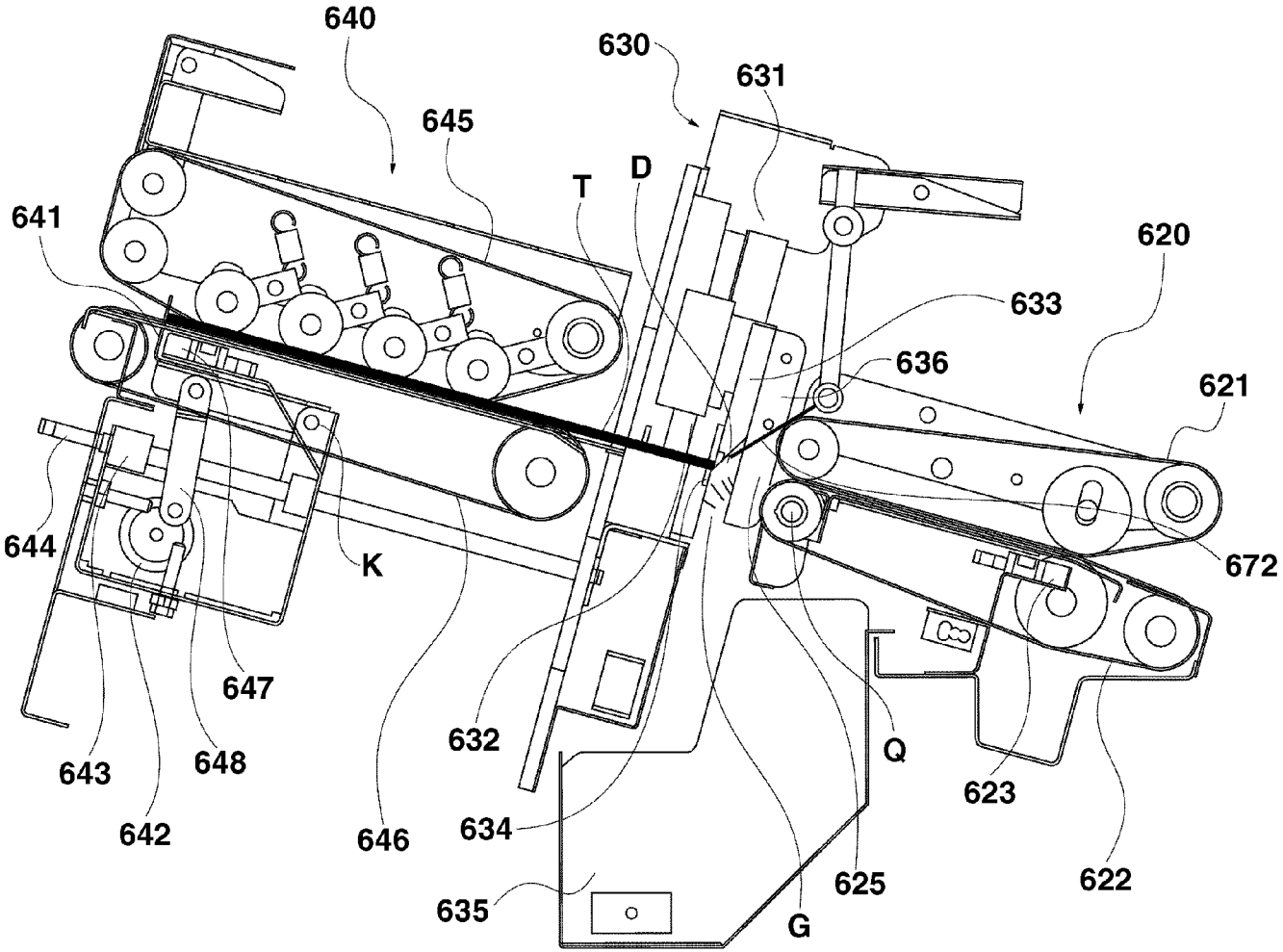
FIG. 10 illustrates an exemplary cutting operation executed by the cutting apparatus.

In step S3, the conveyance belt of the third conveyance unit 640 stops. In step S4, the cutter unit 631 of the trimming unit 630 starts descending by driving of a driving motor M18 (FIG. 7) as illustrated in FIG. 10. Furthermore, in step S4, the trimming unit 630 executes cutting processing on the sheet bundle at the edge of the sheet bundle oriented in the upstream direction of the sheet bundle conveyance direction.

Figure 11:
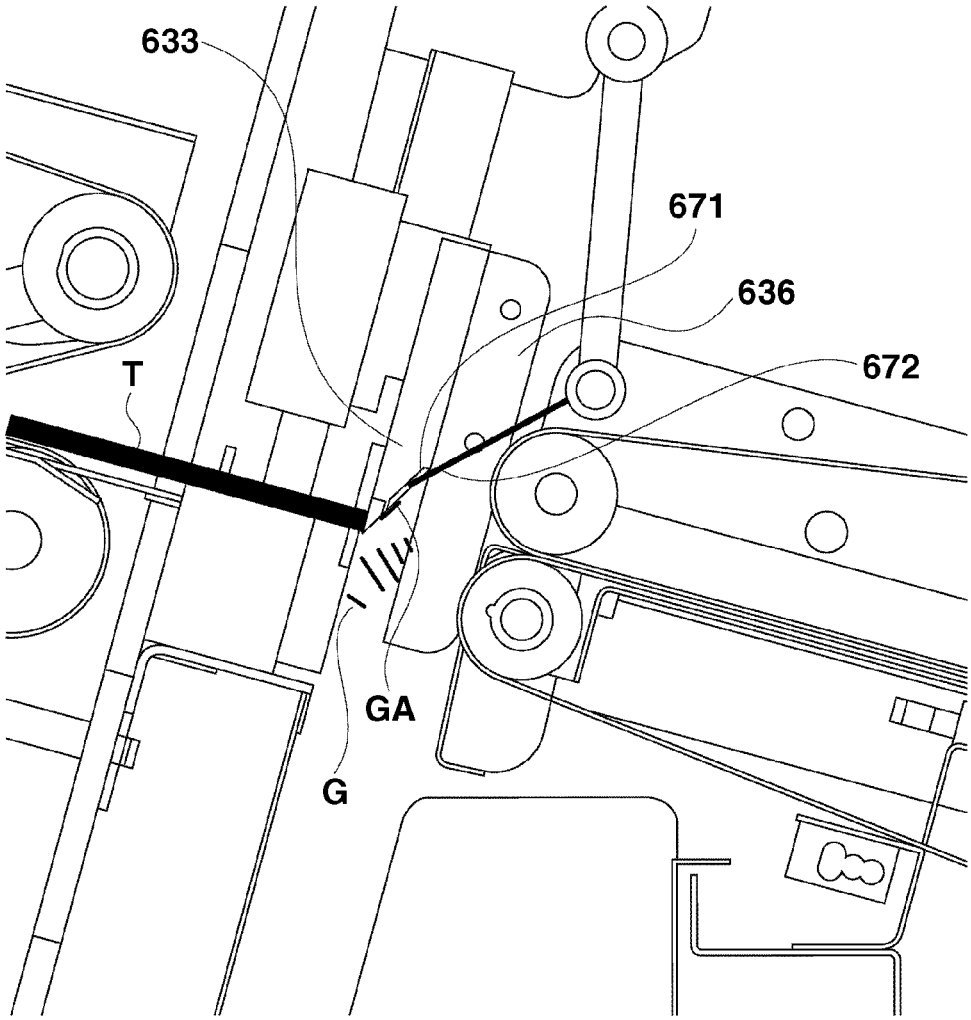
FIG. 11 illustrates an exemplary cutting operation executed by the cutting apparatus.

FIG. 11 is a magnified view illustrating an example of a portion of the sheet bundle cut by the upper blade 633. More specifically, during the cutting processing, the scraper blade 672 enters the groove 671 of the tapered portion 681 as the cutter unit 631 descends. In addition, the cam 636, which is connected to the upper blade 633, presses the shutter 625 as illustrated in FIG. 10. Thus, the passage of the cutting scraps to the scrap receptacle 635 is opened before cutting the sheet bundle. The cutter unit 631 temporarily stops around a bottom dead center D, which exists around a most bottom point of the movable range of the link 637 (FIG. 10).

In step S5, the cutter unit 631 returns to an initial position illustrated in FIG. 9 (up to a top dead center U, which exists around the movable range of the link 637). Furthermore, in step S5, the position of the cutter unit 631 is detected by a top dead center detection sensor 638 illustrated in FIG. 4. In step S6, the cutter unit 631 stops at its initial position.

The stopping time of the cutter unit 631 at the bottom dead center D is set to be short enough for a time period between arrival timings of sheet bundles generated by the saddle stitch binding apparatus 800 each including a smallest number of sheets.

In the above-described manner, the cutter unit 631 stops at the bottom dead center D. Accordingly, time for opening the passage of cutting scraps, which is executed by the shutter 625, can be secured and cutting scraps G can surely drop into the scrap receptacle 635.

When the cutter unit 631 returns to its initial position (the top dead center U), the cam 636 is separated from the shutter 625. Accordingly, the shutter 625 closes the passage of the cutting scraps by the pressure from the twisted coil spring (not illustrated).

In addition, in the example illustrated in FIG. 11, cutting scraps GA, which have adhered to the tapered portion 681, are ripped by the tip of the scraper blade 672, which has entered the groove 671 when the upper blade 633 returns to the top dead center U, and are scraped off the upper blade 633.

Figure 12:
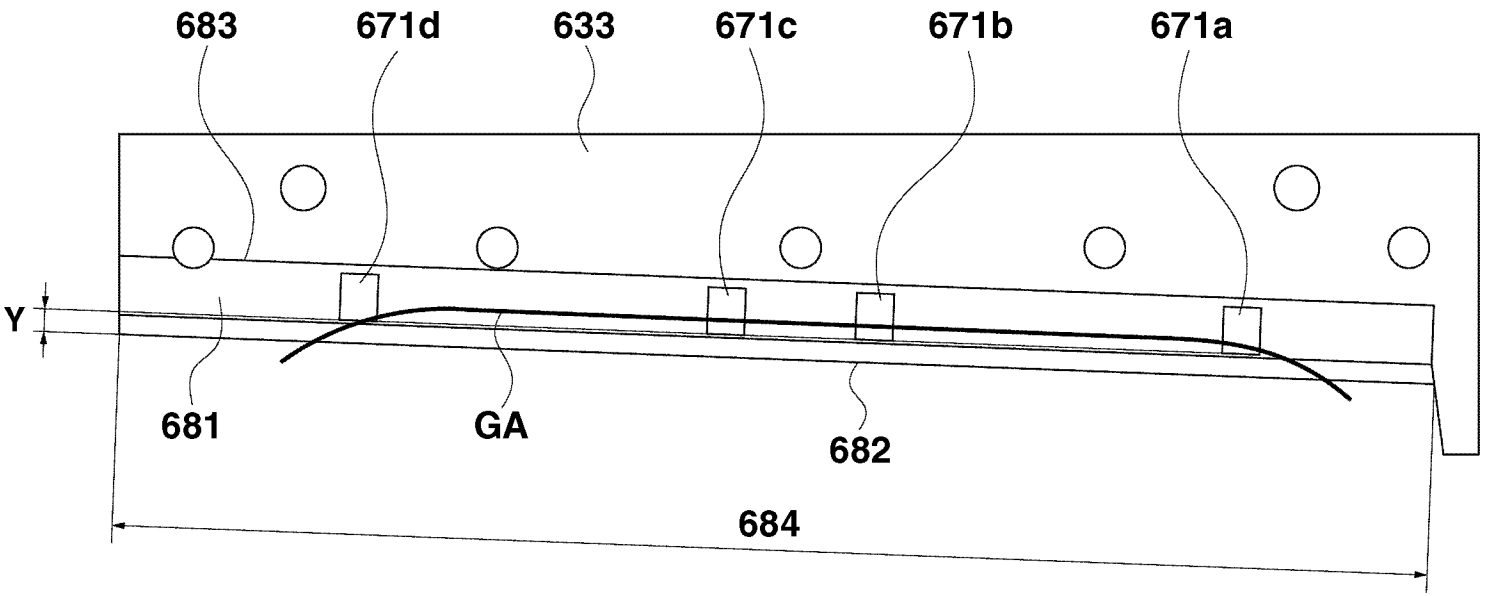
FIG. 12 illustrates an example of a cutting blade of the cutting apparatus.

The scraper blade 672 is provided at a location for scraping the cutting scraps GA off before the shutter 625 is closed. The number of the grooves 671 of the tapered portion 681 and the number of the scraper blades 672 provided in the center portion of the upper blade 633 are greater than the number of those provided on the edge of the upper blade 633 in the longitudinal direction of the upper blade 633 as illustrated in FIG. 12. This is because a scraping force necessary at the central portion of the upper blade 633 is greater than the scraping force necessary at the edge portion of the upper blade 633 because the edge portion of the cutting scraps GA tends to hang down due to the own weight of the cutting scraps GA.

As described above, in the present exemplary embodiment, by providing more scraper members and grooves in the center portion of the upper blade 633 in the longitudinal direction than the number of those provided on the edge portion of the upper blade 633 in the longitudinal direction. Accordingly, the present exemplary embodiment can improve the scraping performance in the center of the upper blade 633 in the longitudinal direction, in which cutting scraps very easily adhere to the upper blade 633. Thus, the present exemplary embodiment can surely remove the cutting scraps.

The grooves 671 are provided up to a portion of the tapered portion 681 whose distance from the cutting edge Y is 2 mm. This is because the cutting amount necessary for tidily cutting and trimming the sheet bundle edge is generally 2 mm.

In most cases, cutting scraps GA may tend to adhere to the upper blade 633 in a skewed state or crooked state rather than in a state parallel to the cutting edge. Accordingly, if the grooves 671 are provided up to a portion whose distance from the cutting edge Y is 2 mm, then most cutting scraps GA can be caught by the grooves 671. Accordingly, the present exemplary embodiment can achieve a high scraping effect.

As described above, in the present exemplary embodiment, the scraper member of a blade-like shape contacts the cutting blade and moves from the step portion of the cutting blade to the cutting edge thereof. Accordingly, the present exemplary embodiment can rip and scrape off the cutting scraps from the cutting blade without utilizing the sliding and frictional force from the scraper member.

Returning to FIG. 8, in step S7, the stopper 641 retracts from the sheet bundle conveyance path. In step S8, the third conveyance unit 640 resumes the conveyance of the sheet bundle.

Figure 13A:
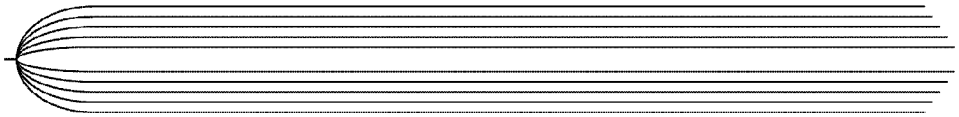
FIGS. 13A and 13B illustrate an example of a sheet bundle yet to be cut and a sheet bundle that has been cut, respectively.

After that, the sheet bundle is conveyed into the fourth conveyance unit 650, which is provided downstream of the third conveyance unit 640. By executing the cutting operation described above, the sheet bundle yet to be cut, which is illustrated in FIG. 13A, is cut and processed into a shape of a cut sheet bundle illustrated in FIG. 13B.

The sheet bundle conveyed by the fourth conveyance unit 650 upwards is discharged onto the paper discharge unit 660. Sheet bundles are serially discharged and stacked onto the paper discharge unit 660 one after another in a mutually overlapping state. In the present exemplary embodiment, the fourth conveyance unit 650 provides a paper discharge port in an upper portion of the copying machine 1000. Accordingly, the present exemplary embodiment can improve the user's easiness of taking out the stacked bundle.

In the present exemplary embodiment, the scraper blade 672 is stationary during the operation for scraping the cutting scraps off. More specifically, in the present exemplary embodiment, the cutter unit 631 is vertically moved during a cutting scrap scraping operation executed during cutting by the cutter unit 631. However, it is also useful if the scraper blade 672 is driven by an actuator during a cutting operation. In this case, the scraper blade 672 and the cutter unit 631 relatively move during a cutting scrap scraping operation.

Now, a second exemplary embodiment of the present invention will be described in detail below. In the present exemplary embodiment, a rotational paddle (rotatable member), served as a scraper member, is used for scraping cutting scraps off instead of using the scraper blade. In the present exemplary embodiment, configurations different from the configurations of the first exemplary embodiment will be described only.

Figure 14:
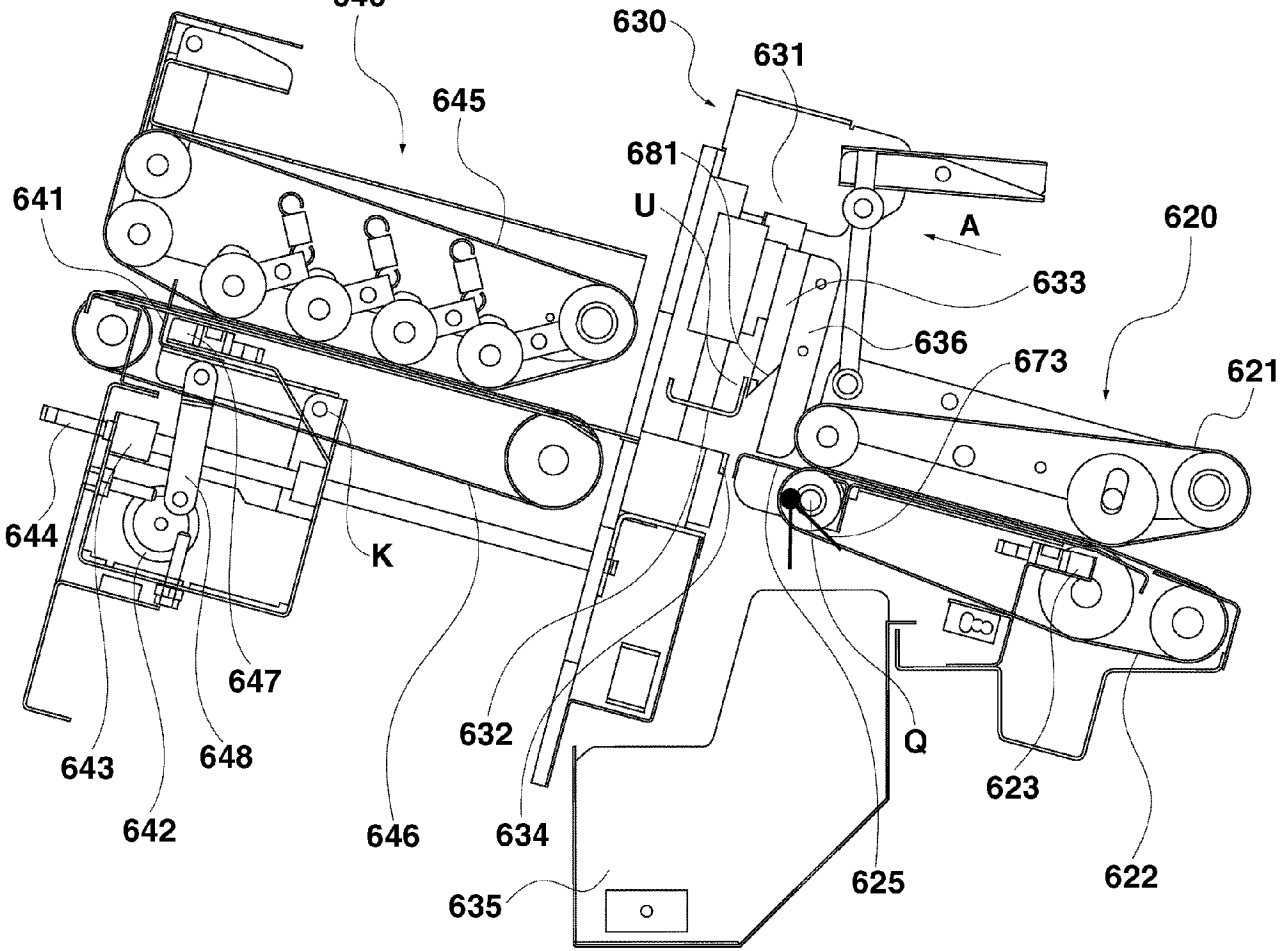
FIG. 14 illustrates an example of a cutting apparatus according to a second exemplary embodiment of the present invention.

FIG. 14 specifically illustrates an exemplary configuration of a trimming unit 630 according to the present exemplary embodiment.

Referring to FIG. 14, a cutter unit 631, which can move in a direction perpendicular to the sheet bundle conveyance direction, is provided to the trimming unit 630. The cutter unit 631 is driven by a driving motor M18 and is moved via a link 637 in a direction perpendicular to the sheet bundle conveyance plane. The cutter unit 631 includes a pressure member 632 and an upper blade 633. When the cutter unit 631 descends, the pressure member 632 contacts the sheet bundle first.

The pressure member 632 is biased by a spring (not illustrated) against the sheet bundle conveyance plane. When the cutter unit 631 further descends, the upper blade 633 contacts the sheet bundle while the pressure member 632 is causing the spring to contract in a state in which the sheet bundle is nipped by the pressure member 632.

The sheet bundle can be cut by the upper blade 633 and a lower blade 634, which is a fixed blade. In addition, a scrap receptacle 635 is provided in a lower portion of the cutter unit 631. The scrap receptacle 635 stores the cutting scraps generated by the cutting by the cutter unit 631.

Moreover, a scrap receptacle 635 is provided in a lower portion of the cutter unit 631. The scrap receptacle 635 stores the cutting scraps generated by the cutting by the cutter unit 631.

Furthermore, a shutter 625 is provided to the cutter unit 631. The shutter 625 opens or closes a passage of cutting scraps to the scrap receptacle 635 as the cutter unit 631 descends. When the cutter unit 631 executes a cutting operation, a cam 636, which is provided outside the sheet bundle conveyance region, presses the shutter 625. Pressed by the cam 636, the shutter 625 pivots round a shaft Q on the downstream side of the second conveyance unit 620 in the sheet conveyance direction.

When not being pressed by the cam 636, the shutter 625 is biased by a twisted coil spring (not illustrated). Accordingly, the shutter 625 can function as a conveyance guide between 622 and the lower blade 634. Thus, the shutter 625 closes the passage of cutting scraps to the scrap receptacle 635. A rotational paddle 673 is provided in the vicinity of the shutter 625.

As illustrated in FIG. 5, a plurality of grooves 671*a* through *d* is provided to a tapered portion 681 of the upper blade 633. More specifically, the tapered portion 681 is a portion of the upper blade 633 between a blade cutting edge 682 and a step portion 683. The plurality of grooves 671*a* through *d* is provided in a direction perpendicular to the direction of the conveyance path so that the tip of the rotational paddle 673 can enter the grooves 671.

In addition, the rotational paddle 673 rotates in, slides in, and rubs the inside of the grooves 671*a* through *d* of the tapered portion 681 while being driven by a driving motor M20 (FIG. 15) starting from the step portion 683 towards the blade cutting edge 682. The rotational paddle 673 is a conductive elastic member such as a conductive rubber, or a conductive resin sheet. Accordingly, the rotational paddle 673 can easily close-contact the tapered portion 681. In addition, charged cutting scraps cannot easily adhere to the rotational paddle 673.

Because the scraper member (the rotational paddle 673) according to the present exemplary embodiment is an elastic member, the rotational paddle 673 can securely contact the cutting blade. The present invention is not limited to the exemplary configuration described above. More specifically, it is also useful, at least one groove and at least one rotational paddle (rotatable member) may be provided.

A paper discharge unit 660 is provided at the most downstream location in the sheet conveyance direction. The paper discharge unit 660 stacks the sheet bundle conveyed by the fourth conveyance unit 650.

Now, an exemplary sheet cutting operation executed by the trimmer unit 600 according to the present exemplary embodiment will be described in detail below with reference to a flow chart of FIG. 15, focusing on how each unit operates as a sheet bundle is conveyed.

Figure 15:
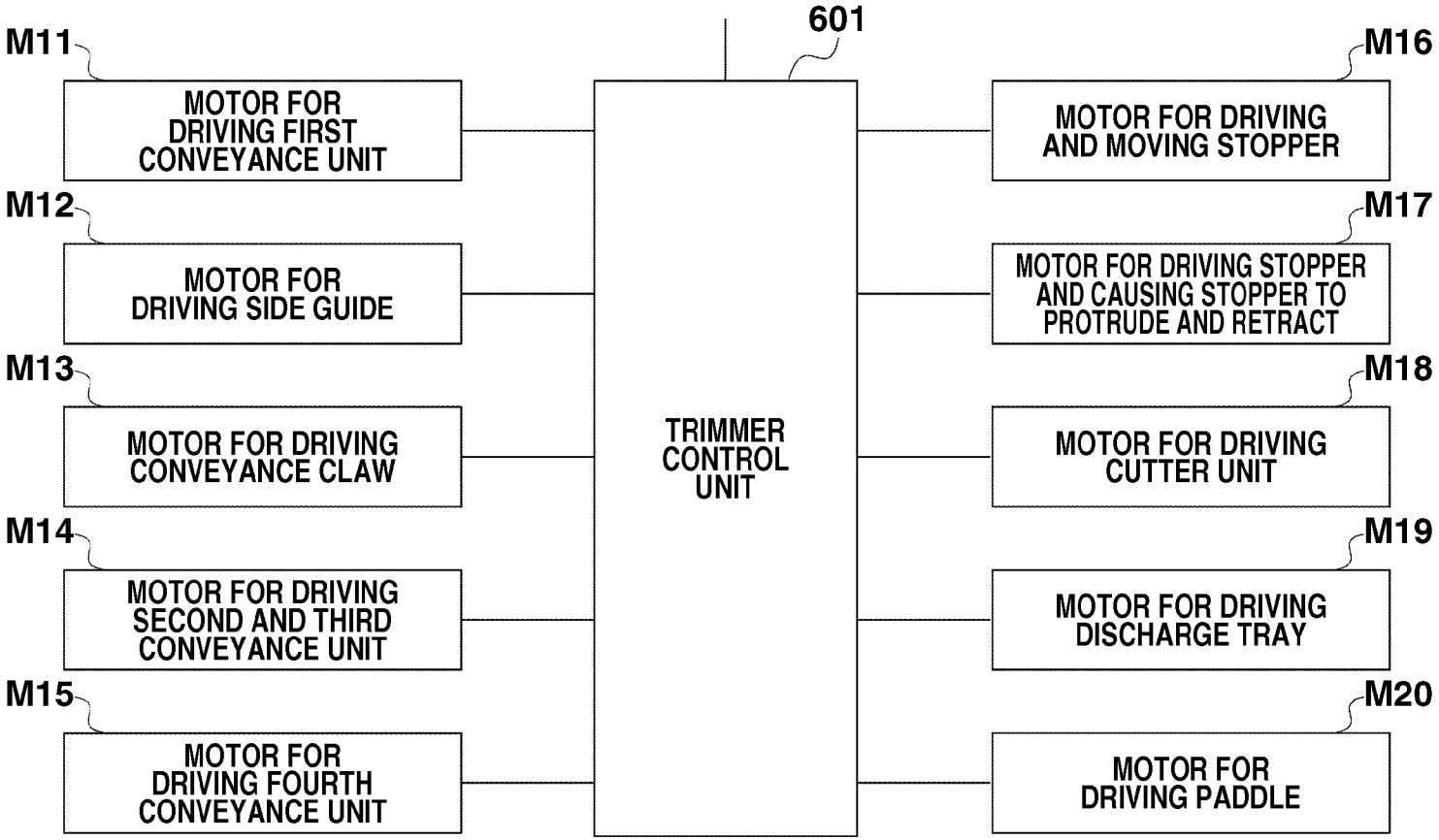
FIG. 15 is a control block diagram illustrating an example of the cutting apparatus.

FIG. 15 is a block diagram illustrating an exemplary configuration of the trimmer control unit 601 according to the present exemplary embodiment. The trimmer control unit 601 controls each driving motor.

Figure 19:
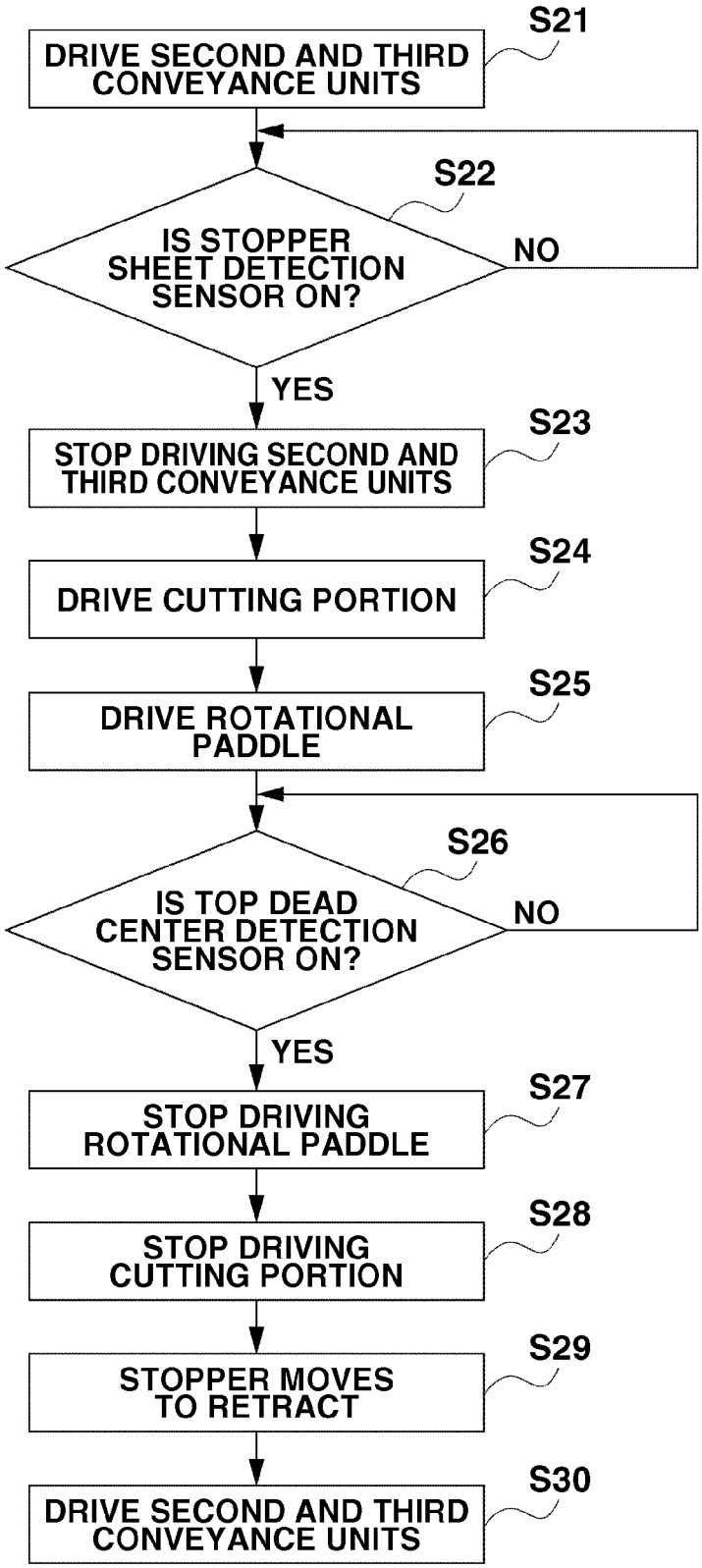
FIG. 19 is a flow chart illustrating an exemplary cutting operation executed by the cutting apparatus.

Now, an example of the cutting operation executed by the trimmer unit 600 will be described in detail below with reference to a flow chart of FIG. 19. Referring to FIG. 19, in step S21, the edge of the sheet bundle oriented in the downstream side of the sheet conveyance direction thereof passes the second conveyance unit 620 and the trimming unit 630, and then the sheet bundle is conveyed into the third conveyance unit 640. The conveyance belts of the second conveyance unit 620 and the third conveyance unit 640 are driven by the same driving motor M14 (FIG. 15).

In the third conveyance unit 640, the stopper 641 is driven by a driving motor M16 (FIG. 7) to be moved and stopped at a predetermined position according to the size of the conveyed sheet bundle and the cutting amount. The stopper 641 is driven by a driving motor M17 to protrude into the sheet bundle conveyance path.

Figure 16:
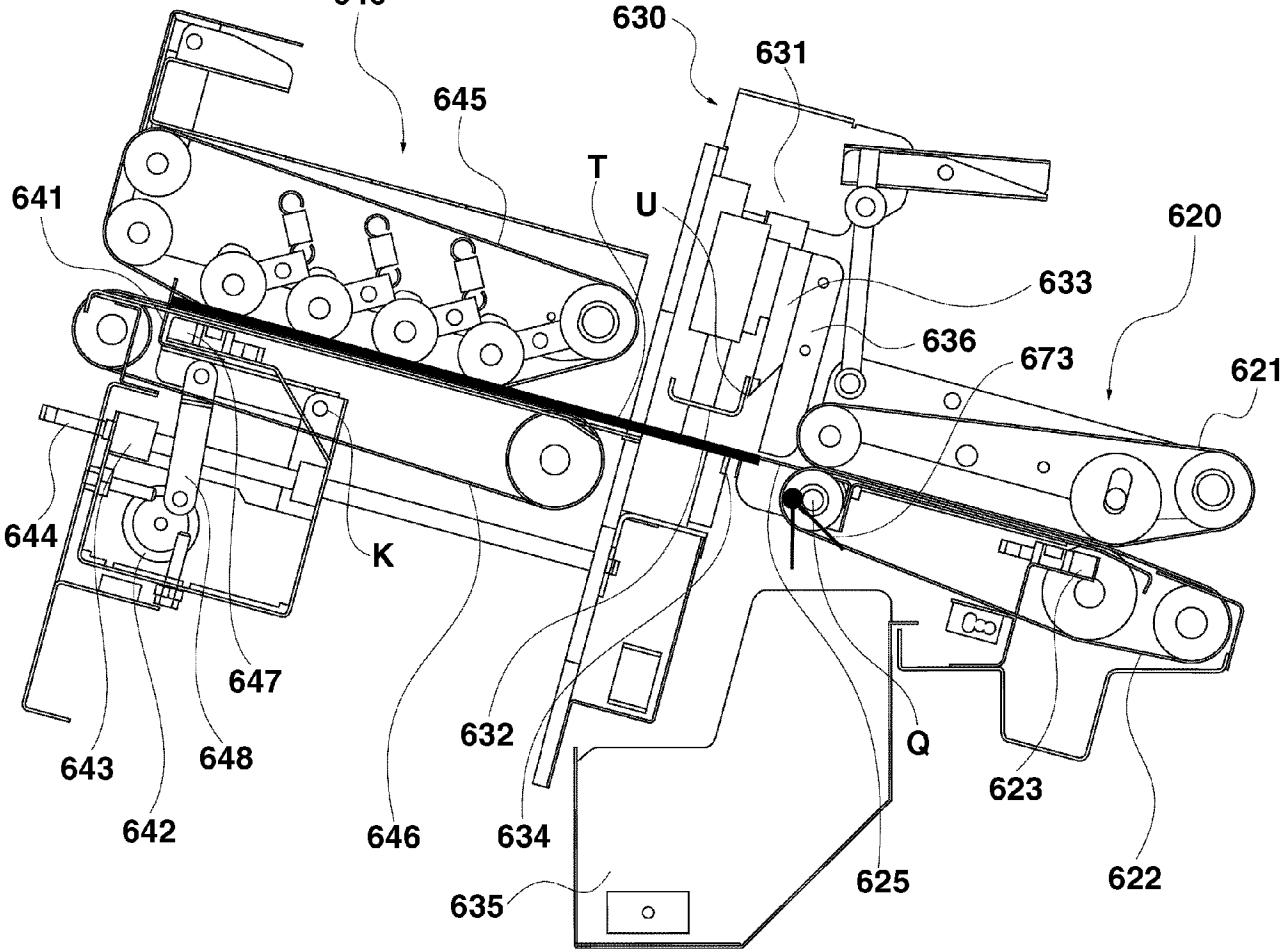
FIG. 16 illustrates an exemplary cutting operation executed by the cutting apparatus.

In step S22, the edge of the conveyed sheet bundle oriented to the downstream side of the sheet bundle conveyance direction contacts the stopper 641 and is stopped there to be detected by a sheet detection sensor 647. FIG. 16 illustrates an example of a state in which the edge of the conveyed sheet bundle oriented to the downstream side of the sheet bundle conveyance direction contacts the stopper 641 to be stopped there.

In step S23, the conveyance belt of the third conveyance unit 640 stops. In step S24, the cutter unit 631 of the trimming unit 630 starts descending by driving of a driving motor M18 (FIG. 17) as illustrated in FIG. 10. Furthermore, in step S24, the trimming unit 630 executes cutting processing on the sheet bundle at the edge of the sheet bundle oriented in the upstream direction of the sheet bundle conveyance direction.

More specifically, the cam 636, which is connected to the upper blade 633, presses the shutter 625. Thus, the passage of the cutting scraps to the scrap receptacle 635 is opened before cutting the sheet bundle.

Figure 18:
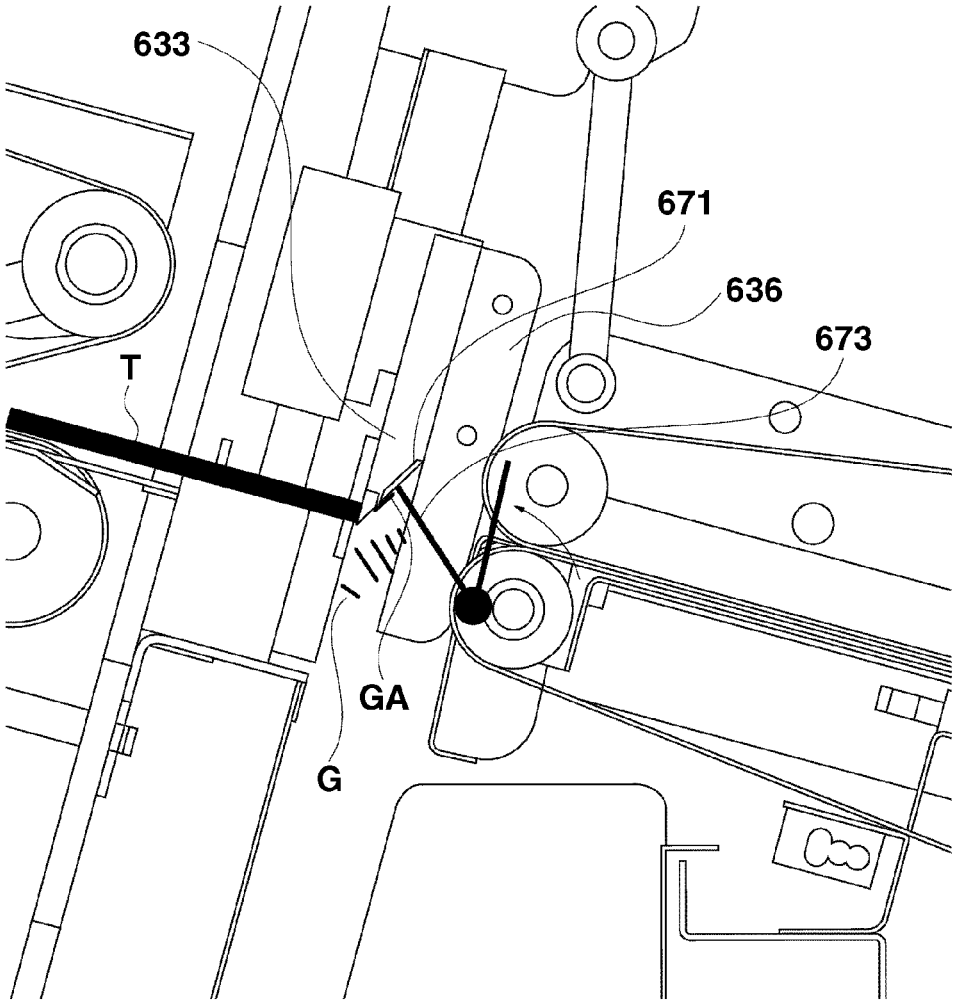
FIG. 18 illustrates an exemplary cutting operation executed by the cutting apparatus.

As illustrated in FIG. 18, which is a magnified view illustrating an example of a portion of the sheet bundle cut by the upper blade 633, in step S25, the rotational paddle 673 is rotated to be driven by a driving motor M20 (FIG. 15) in a direction indicated by an arrow in FIG. 18 (in the counterclockwise direction) as the cutter unit 631 descends to enter the grooves 671 of the tapered portion 681.

Figure 17:
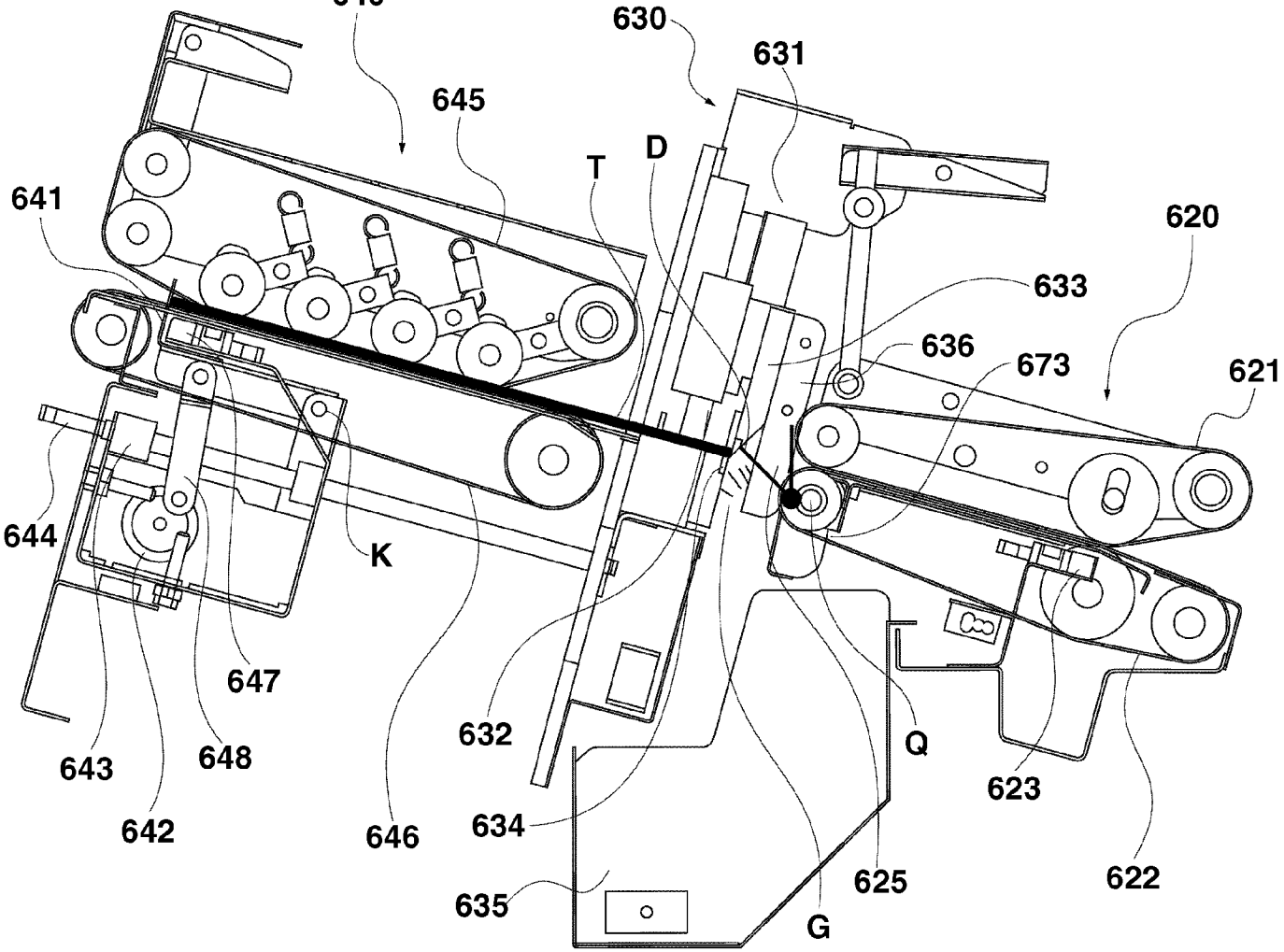
FIG. 17 illustrates an exemplary cutting operation executed by the cutting apparatus.

The cutter unit 631 temporarily stops around the bottom dead center D, which exists in the vicinity of a most bottom point of the movable range of the link 637 (FIG. 17). Then, the cutter unit 631 returns to its initial position illustrated in FIG. 16 (up to a top dead center U, which exists around the movable range of the link 637).

The portion of the rotational paddle 673 contacting the grooves 671 moves and rotates at a speed higher than the speed of the cutting by the cutter unit 631. Accordingly, the present exemplary embodiment can secure a sufficient number of times of scraping operations and a sufficiently high scraping force.

Cutting scraps GA, which have adhered to the tapered portion 681, are ripped and scraped off the adhesion surface by the rotational paddle 673, which has entered the grooves 671, before the upper blade 633 returns to the top dead center U.

As described above, the present exemplary embodiment uses the rotational paddle (rotatable member) as the scraper member. Accordingly, in the present exemplary embodiment, a plurality of number of times of scraping operations can be executed during the cutting operation. Therefore, the present exemplary embodiment can surely remove the cutting scraps.

In addition, in the present exemplary embodiment, the rotational speed of the scraper member is higher than the speed of the cutting operation. Therefore, the present exemplary embodiment can secure the sufficiently high scraping force during the cutting operation. Accordingly, the present exemplary embodiment can surely remove the cutting scraps.

In step S26, the position of the cutter unit 631 is detected by a top dead center detection sensor 638 illustrated in FIG. 4. In step S27, the rotational paddle 673 stops. In step S28, the cutter unit 631 also stops.

The stopping time of the cutter unit 631 at the bottom dead center D is set to be short enough for a time period between arrival timings of sheet bundles generated by the saddle stitch binding apparatus 800 each including a smallest number of sheets.

In the above-described manner, the cutter unit 631 stops at the bottom dead center D. Accordingly, time for opening the passage of cutting scraps, which is executed by the shutter 625, can be secured and cutting scraps GA can surely drop into the scrap receptacle 635.

When the cutter unit 631 returns to its initial position (the top dead center U), the cam 636 is separated from the shutter 625. Accordingly, the shutter 625 closes the passage of the cutting scraps by the pressure from the twisted coil spring (not illustrated).

In step S29, the stopper 641 retracts from the sheet bundle conveyance path. In step S30, the third conveyance unit 640 resumes the conveyance of the sheet bundle. After that, the sheet bundle is conveyed into the fourth conveyance unit 650, which is provided downstream of the third conveyance unit 640.

Figure 13B:
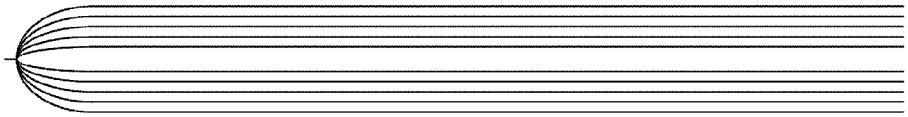

By executing the cutting operation described above, the sheet bundle yet to be cut, which is illustrated in FIG. 13A, is cut and processed into a shape of a cut sheet bundle illustrated in FIG. 13B.

Figure 20:
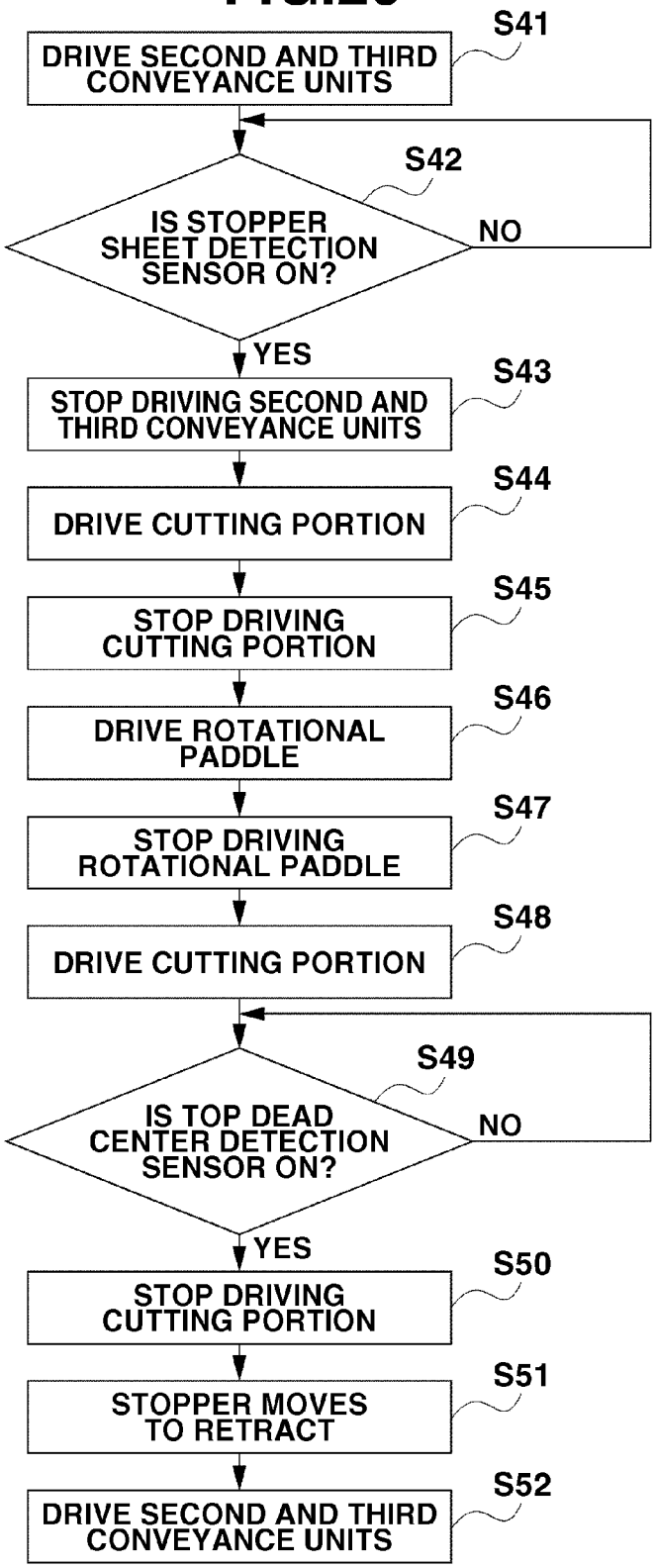
FIG. 20 is a flow chart illustrating an exemplary cutting operation executed by the cutting apparatus according to other exemplary embodiments of the present invention.

The present invention is not limited to the exemplary embodiments described above. More specifically, it is also useful, in steps S44 through S50 (FIG. 20, which illustrates another exemplary cutting operation by the trimming unit 630), if all the scraping operations by the rotational paddle 673 are executed when the cutter unit 631 temporarily stops around the bottom dead center D during the cutting operation.

If the above-described another exemplary embodiment of the present invention is employed, the upper blade 633 and the lower blade 634 are overlapped with each other by a maximum overlapping area. Accordingly, the cutting scraps scraped off the upper blade 633 may not easily adhere to the cutting edge of the lower blade 634.

With the above-described configuration, the present exemplary embodiment can surely remove cutting scraps by scraping the cutting blade at the position of the maximum overlapping area (at the position at which the cutting of the sheet bundle is completed).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155678 filed Jun. 30, 2009, which is hereby incorporated by reference herein in its entirety.

What is claimed is:

1. An apparatus configured to cut a sheet comprising:

a movable cutting blade configured to move in a cutting direction intersecting with a surface of the sheet to be cut; and a plurality of scraper members configured to scrape cutting scraps off the movable cutting blade, wherein the movable cutting blade including:

a cutting edge having a linear shape;

a tapered portion tapered toward the cutting edge; and a plurality of grooves, provided on the tapered portion along a longitudinal direction of the cutting edge, each of which extends along the cutting direction, wherein each ends of the plurality of grooves in the cutting direction is separated from the cutting edge, wherein the plurality of scraper members enter the plurality of grooves and scrape off cutting scraps adhered to the tapered portion.

2. The apparatus according to claim 1, wherein each of the scraper members is a blade, and wherein the blade is provided so as to contact the groove of the movable cutting blade.

3. The apparatus according to claim 1, wherein the movable cutting blade and the scraper members are configured to relatively move and scrape off cutting scraps.

4. The apparatus according to claim 1, wherein each of the scraper members is a rotatable member provided so as to contact the groove of the movable cutting blade.

5. The apparatus according to claim 4, wherein a rotational speed of the rotatable member is higher than a moving speed of the movable cutting blade.

6. The apparatus according to claim 4, wherein the movable cutting blade is configured to execute a cutting operation in cooperation with a fixed cutting blade, which is provided at an opposite location of the movable cutting blade across a sheet to be cut, and wherein the rotatable member is rotated at a position at which areas of the movable cutting blade and the fixed cutting blade are mutually overlapped at a maximum during the cutting operation.

7. The apparatus according to claim 1, wherein each of the scraper members is an elastic member.

8. The apparatus according to claim 7, wherein each of the scraper members is a conductive member.

9. The apparatus according to claim 1, wherein the cutting blade is provided with more grooves in a center portion thereof than on an edge of the cutting blade in the longitudinal direction of the cutting edge.

10. An image forming apparatus comprising:

an image forming unit configured to form an image on a sheet; and an apparatus according to claim 1.

11. The image forming apparatus according to claim 10, wherein each of the scraper members is a blade, and wherein the blade is provided so as to contact the groove of the movable cutting blade.

12. The image forming apparatus according to claim 10, wherein the movable cutting blade and the scraper members are configured to relatively move and scrape off cutting scraps.

13. The image forming apparatus according to claim 10, wherein each of the scraper members is a rotatable member provided so as to contact the groove of the movable cutting blade.

14. The image forming apparatus according to claim 13, wherein a rotational speed of the rotatable member is higher than a moving speed of the movable cutting blade.

15. The image forming apparatus according to claim 13, wherein the movable cutting blade is configured to execute a cutting operation in cooperation with a fixed cutting blade, which is provided at an opposite location of the movable cutting blade across a sheet to be cut, and wherein the rotatable member is rotated at a position at which areas of the movable cutting blade and the fixed cutting blade are mutually overlapped at a maximum during the cutting operation.

16. The image forming apparatus according to claim 10, wherein each of the scraper members is an elastic member.

17. The image forming apparatus according to claim 1, wherein each of the scraper members is a conductive member.

18. The image forming apparatus according to claim 10, wherein the cutting blade is provided with more grooves in a center portion thereof than on an edge of the cutting blade in the longitudinal direction of the cutting edge.

19. An apparatus configured to cut a sheet comprising:

a movable cutting blade configured to move in a cutting direction for cutting the sheet, the movable cutting blade including a cutting edge having a linear shape as a leading end in the cutting direction, a tapered portion tapered toward the cutting edge and having a flat surface, and a plurality of grooves provided on the flat surface of the tapered portion and extending along the cutting direction, wherein each ends of the plurality of grooves in the cutting direction is separated from the cutting edge; and a plurality of scraper portions arranged to enter the plurality of grooves.

* * * * *